US006796855B2

(12) United States Patent
Fricke et al.

(10) Patent No.: US 6,796,855 B2
(45) Date of Patent: Sep. 28, 2004

(54) ELECTRICAL CONDUCTOR CONNECTING MEANS

(75) Inventors: Herbert Fricke, Detmold (DE); Jörg Diekmann, Oerlinghausen (DE); Manfred Wilmes, Detmold (DE); Michael Lenschen, Detmold (DE); Rainer Schulze, Detmold (DE); Siegfried Storm, Schlangen (DE); Thomas Tappe, Detmold (DE); Thomas Wielsch, Horn (DE); Jochen Reese, Lemgo (DE)

(73) Assignee: Weidmueller Interface GmbH & Co., Detmold (DE)

( * ) Notice: Subject to any disclaimer, the term of this patent is extended or adjusted under 35 U.S.C. 154(b) by 0 days.

(21) Appl. No.: 10/411,219

(22) Filed: Apr. 11, 2003

(65) Prior Publication Data

US 2003/0194918 A1 Oct. 16, 2003

(30) Foreign Application Priority Data

Apr. 12, 2002 (DE) ..... 202 05 821 U
Jul. 13, 2002 (DE) ..... 202 11 513 U

(51) Int. Cl.[7] ..... H01R 4/48
(52) U.S. Cl. ..... 439/835
(58) Field of Search ..... 439/775, 786, 439/835, 828, 435, 436, 441

(56) References Cited

U.S. PATENT DOCUMENTS 5,816,867 A * 10/1998 Davidsz et al. ..... 439/828
5,879,204 A 3/1999 Delarue et al. ..... 439/835
5,938,484 A 8/1999 Beege et al. ..... 439/828
6,074,242 A * 6/2000 Stefaniu et al. ..... 439/441
6,146,186 A * 11/2000 Barrat et al. ..... 439/410
6,146,187 A * 11/2000 Pallai ..... 439/441
6,254,422 B1 * 7/2001 Feye-Hohmann ..... 439/441
6,257,919 B1 * 7/2001 Cutler et al. ..... 439/441
6,261,120 B1 7/2001 Beege et al. ..... 439/441
6,280,233 B1 8/2001 Beege et al. ..... 439/441
6,350,162 B1 2/2002 Despang ..... 439/835

FOREIGN PATENT DOCUMENTS

| | | | |
|---|---|---|---|
| DE | 6941200 | U1 | 7/1970 |
| DE | 2060532 | A | 6/1972 |
| DE | 2440825 | A1 | 3/1976 |
| DE | 81360541 | U1 | 3/1982 |
| DE | 3520826 | A1 | 12/1986 |
| DE | 4231244 | A | 3/1994 |
| DE | 29500614.5 | | 3/1995 |
| DE | 19614977 | A1 | 10/1996 |
| DE | 29813262 | U1 | 11/1998 |
| DE | 19736739 | A1 | 3/1999 |
| DE | 29824519 | U1 | 7/2001 |
| JP | 44576 | A | 1/1992 |
| WO | 0213319 | A1 | 2/2002 |

* cited by examiner

*Primary Examiner*—Tulsidas C. Patel
(74) *Attorney, Agent, or Firm*—Lawrence E. Laubscher, Sr.

(57) ABSTRACT

An electrical connector includes a metal housing having at least one side wall, and first and second end walls cooperating with the side wall to define an open-topped chamber, an inverted generally U-shaped resilient contact having first and second leg portions introduced into the chamber adjacent the first and second end walls, respectively, and a bridging portion adjacent the open top of the metal housing, the housing side wall having a bent portion for supporting the resilient contact bridging portion, the resilient contact first leg portion being connected against coplanar movement relative to the housing first end wall. The resilient contact second leg portion is biased outwardly from the first leg portion, thereby to bias a conductor introduced within the housing chamber toward engagement with a bus bar defined adjacent the housing second end wall. The housing may be formed of an electrically conductive metal, such as copper. The free extremity of the second contact leg may be bifurcated to improve the biasing of one or more conductors against the bus bar.

37 Claims, 25 Drawing Sheets

5d
3
5b
5c
13

5a
14
3b
1
5b
5c
4a
4c
25
3d
5e 3c
3b
5d
4b
4c
25
10a
3a
11
7
5e
3d 4
5c
5d
11
4
10a
3
5a
7

ELECTRICAL CONDUCTOR CONNECTING MEANS

BACKGROUND OF THE INVENTION

1. Field of the Invention

An electrical connector is disclosed including an open-topped metal housing having at least one side wall and a pair of end walls cooperating to define a chamber, an inverted generally U-shaped resilient contact having a pair of leg portions extending downwardly within said chamber, and a bridging portion arranged adjacent the top of the housing, support means carried by said side wall for supporting said bridging portion of said resilient contact, connecting means connecting a first leg of said resilient contact against lateral displacement relative to a first one of said end walls, whereby the other second contact leg is biased outwardly toward bus bar means adjacent the other housing end wall, and stop means carried by said side wall for limiting the extent of displacement of said second contact leg toward said first contact leg when a conductor is inserted between said bus bar means and said second contact leg. The housing may be formed from a conductive metal, such as copper. The tip of the second contact leg may be bifurcated to effect an improved connection between the conductor and the bus bar.

2. Brief Description of the Prior Art

Electrical connector devices including resilient contacts for biasing a conductor into electrical engagement with a bus bar are well known in the patented prior art, as shown by the U.S. patents to Delarue, et al., U.S. Pat. No. 5,879,204; Beege, et al., U.S. Pat. Nos. 5,938,484 and 6,261,120; Beege, et al., U.S. Pat. No. 6,280,233; and Despang U.S. Pat. No. 6,350,162, and the German patents Nos. DE 197 376 739 A1, DE 42 31 244 A1, DE 35 20 826 A1, DE 24 40 825 A1, DE 295 00614 A1, DE 81 36 054 U1, DE 69 41 200 U1, and WO 02/13 319 A1.

Against the background of this state of the art, there is a need for a connecting device with resilient contact that can be handed in a particularly simple manner, that can be produced at a reasonable cost and that can be employed in many different ways; this should necessitate the minimum possible requirement for adaptation of the equipment such as terminal blocks or printed circuit boards that will receive the connecting device.

Solving this problem is the purpose of this invention.

SUMMARY OF THE INVENTION

Accordingly, a primary object of the invention is to provide an electrical connector including an open-topped metal housing having at least one side wall and a pair of end walls cooperating to define a chamber, an inverted generally U-shaped resilient contact having first and second leg portions extending downwardly within said chamber, and a bridging portion arranged adjacent the top of the housing, support means carried by said side wall for supporting said contact bridging portion, connecting means connecting said first contact leg against lateral displacement relative to a first one of said end walls, whereby the second contact leg is biased outwardly toward bus bar means adjacent the other housing end wall, and stop means carried by said side wall for limiting the extent of displacement of said second contact leg toward said first contact leg when a conductor is inserted between said bus bar means and said second contact leg.

According to a more specific object of the invention, the metal housing is contained in the cavity of a terminal block formed of a synthetic plastic electrical insulating material, said block containing a first opening from introducing the bare end of an insulated conductor between the resilient contact second leg and the bus bar means, and a second opening for introducing an operating tool such as the tip of a screwdriver into the chamber to release the second contact leg from the conductor, thereby to permit removal of the conductor from the cavity of the terminal block.

According to a more specific object of the invention, the first contact leg is attached to the inside of the first side wall of the metal housing and that it rests segmentally directly on the inside of the side wall, that the bridging section of the resilient contact rests at least on a support molded directly upon the metal housing, a projection being provided on the inside of one of the side walls of the metal housing to serve as a stop for the deflection of the clamping leg. It is also conceivable that the metal housing consists of an electrically conductive metal, such as copper, and assumes a current-conducting function or that the bus bar and the metal housing be made in one piece from conducting material.

A further object of the invention is to provide a resilient contact in which the tip of the second contact leg is bifurcated, thereby to more accurately and positively position and bias one or more conductors into engagement with the stationary bus bar.

The present invention provides a particularly reasonably priced connecting device consisting of a few parts with a resilient contact that is fixed in the metal housing so that it cannot be extracted exclusively by means of function elements made directly on the metal housing where all forces involved in the activation are absorbed by the metal housing, which can be inserted in a terminal block housing as a whole or as a preassembled unit or which can be mounted on a printed circuit board. In this way, it is merely necessary, for example, in a terminal block, to provide a recess adapted to the external geometry, but one does not need any bridges or the like on the terminal housing or a conductor lath that assume special functions, for example, an extraction safety for the resilient contact or the function of a stop. Instead, these functions are taken care of by the metal resilient contact.

BRIEF DESCRIPTION OF THE DRAWINGS

Other objects and advantages of the invention will become apparent from a study of the following specification when viewed in the light of the accompanying drawings, in which:

FIGS. 1*k* and 1*l* are exploded views illustrating the operation of the apparatus of FIG. 1*h*.

FIGS. 18*a* and 18*b* are perspective views illustrating a further method for attachment of the connector to circuit boards and the like;

DETAILED DESCRIPTION

Figure 1B:
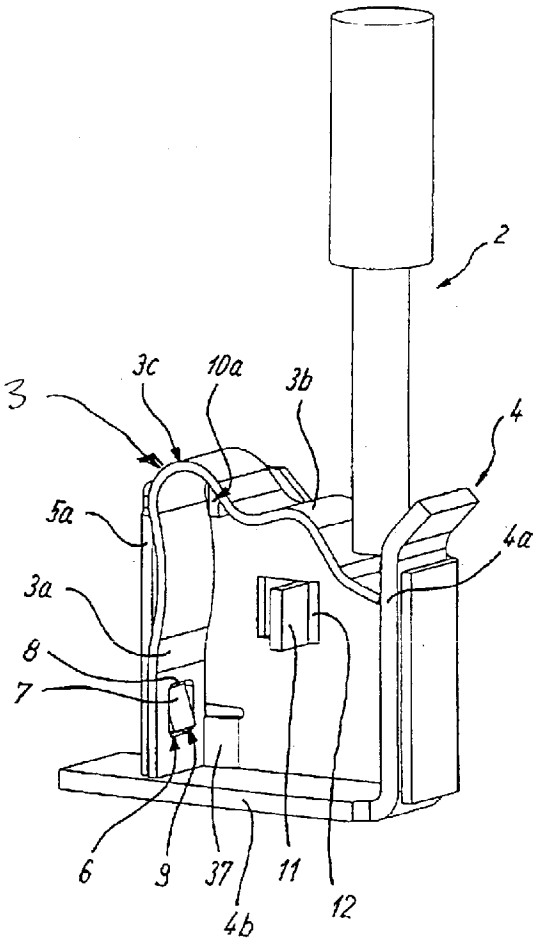
FIG. 1*b* is a corresponding perspective view with certain parts broken away, illustrating the manner of connection of an electrical conductor to the connector.

Referring first more particularly to FIGS. 1*a* to 1*d*, the electrical connector 1 is operable to connect a conductor 2 (FIG. 1*b*) with a bus bar 4 that is arranged within a metal housing 5 containing a resilient contact 3.

Figure 1A:
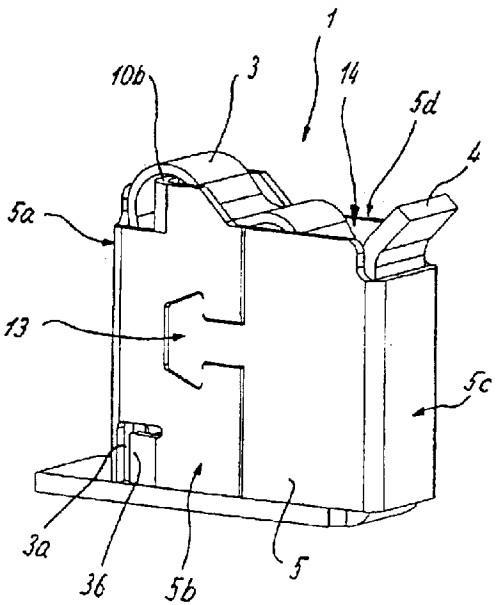
FIG. 1*a* is a side perspective view of a first embodiment of the electrical connector of the present invention.

The metal housing 5 has a rectangular cross-section with four side and end walls 5*a*–5*d* and is open on both of its upper and lower ends and one of the open sides—in FIG. 1*a* the upper open side—is used as insertion opening 14 for a conductor 2 and an actuating tool or the like.

The first and second end walls 5*a* and 5*c*, which are opposite each other and which are aligned parallel to each other, are narrower than the other two mutually parallel first and second side walls 5*b* and 5*d*.

FIG. 1*b* shows the connecting device for a better understanding without the front side wall 5*b*. As one can see, the resilient contact 3, which is made of a rectangular sheet metal strip, has two longitudinal legs 3*a* and 3*b* that are aligned at an acute angle toward each other and that are connected with each other via a bending bridge portion 3*c*.

The first longitudinal leg 3*a* of the resilient contact 3 is attached on the inside of the first end wall 5*a* of metal housing 5 and is positioned segmentally directly on the inside of side wall 5*a*. Its dimensions correspond to the dimensions of the inside of the first side wall 5*a*.

Bus bar 4 has an L-shaped side view profile and, with its contact leg 4*a*, rests against the inside of the second end wall 5*c*, which is opposite the first end wall for the fastening of the resilient contact 3. The second leg 4*b* grasps over the axial opening of metal housing 5, which opening faces away from the insertion opening 14, and in that way forms a limitation or a stop for conductor 2 when said conductor is inserted into the connecting device.

The first longitudinal leg 3*a* has a recess 6 that is engaged by a projection 7 of the first end wall 1*a*, which projection juts out inward. The recess here is rectangular and is positioned toward the side of end wall 1*a* that faces away from the insertion side for conductor 2. Projection 7 here likewise is rectangular. It is made in the following manner: A U-shaped punchout is punched into the first end wall 1*a*, whereupon the metal flap, which on one side is connected in a bending section 8 with the first end wall 1*a*, is bent over inward. Here, bending section 8 is positioned toward projection 7 of the insertion side of the conductor. In this way, it is possible during assembly to insert the resilient contact 3 into the metal housing from the insertion side for the conductors, whereby recess 6 slips over projection 7 and there, behind the latter, there is caught an edge forming an undercut 9. Resilient contact 3 is thus secured in a simple manner against unintentional separation out of metal housing 5 during the disconnection of the connecting device 1.

Molded upon the side walls 5*b* and 5*d* of metal housing 5 is a bridge support portion 10*a* (FIG. 1*b*) and 10*b* (FIG. 1*a*) in each case on the insertion side whose length corresponds, for example, to half of the width of the resilient contact 3 and that are bent normal to the particular side wall planes also inwardly. These bridge support portions 10 in a simple manner serve as support for bending section 3*c* of friction spring 3*d*.

The second contact leg 3*b* extends obliquely with respect to the direction of insertion for the conductor into the metal housing and here, in the unconnected state, extends all the way to bus bar 4 and rests against that bus bar.

The second contact leg is bent twice in serpentine form. Upon insertion of the conductor, the second contact leg 3*b*—also called clamping leg—is deflected in the direction of insertion downward. Its movement is limited in this direction by a stop projection 11 pointing inward on the second side wall 5*d*, which is formed as a flap that is connected unilaterally with tie side wall in a bending section 12 and which is punched out U-shaped on three sides.

Metal housing 5 is also shaped as a bending part from a piece of sheet metal which, after punchout, is bent into the shape of the metal housing 5 with its rectangular cross-section, where the point of intersection of the edges of the sheet metal strip here lies in the area of the first side wall 5*b* and where the two edges engage each other via an interlocking connection 13.

Other projections or punchouts 36 (FIG. 1*a*) and 37 (FIG. 1*b*) in the side walls 5*b* and 5*d* in the corner areas adjacent the first end wall 5*a* press the resilient contact 3 in the area of longitudinal leg 3*a* against the first end wall 5*a*.

The bent end of the bus bar, which protrudes out of insertion opening 14 for conductor 2 as well as the terminal leg 3*b* of the resilient contact 3 together form a kind of funnel-shaped insertion area that facilitates insertion of conductor 2 into connecting device 1.

An outward bulge 15 (FIG. 16) in the first longitudinal leg 3*a* of the friction spring above recess 6 is used to optimize the tension.

The following is created here: an essentially fully functioning connecting device for conductors that can be used in many different ways without requiring any major adaptations at the place of use. For example, it is possible to inset the connecting device in a terminal block and essentially to provide only a recess adapted to the geometry of the connecting device for the insertion of the connecting device. Special bridges and the like, which, for example, serve as stop elements for any movable parts of the connecting device, are not required here.

Figure 1D:
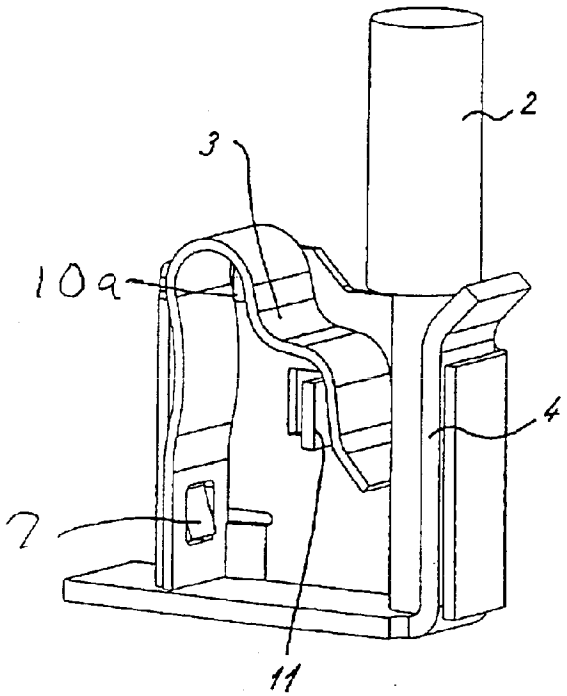
FIG. 1*d* illustrates the conductor fully inserted within the connector housing.
Figure 1C:
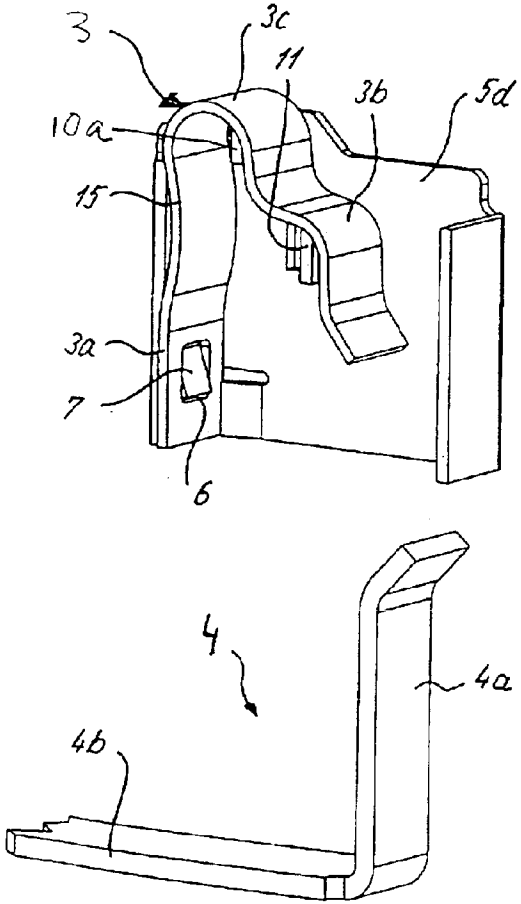
FIG. 1*c* is an exploded view of the connector of FIG. 1*b*.
Figure 1F:
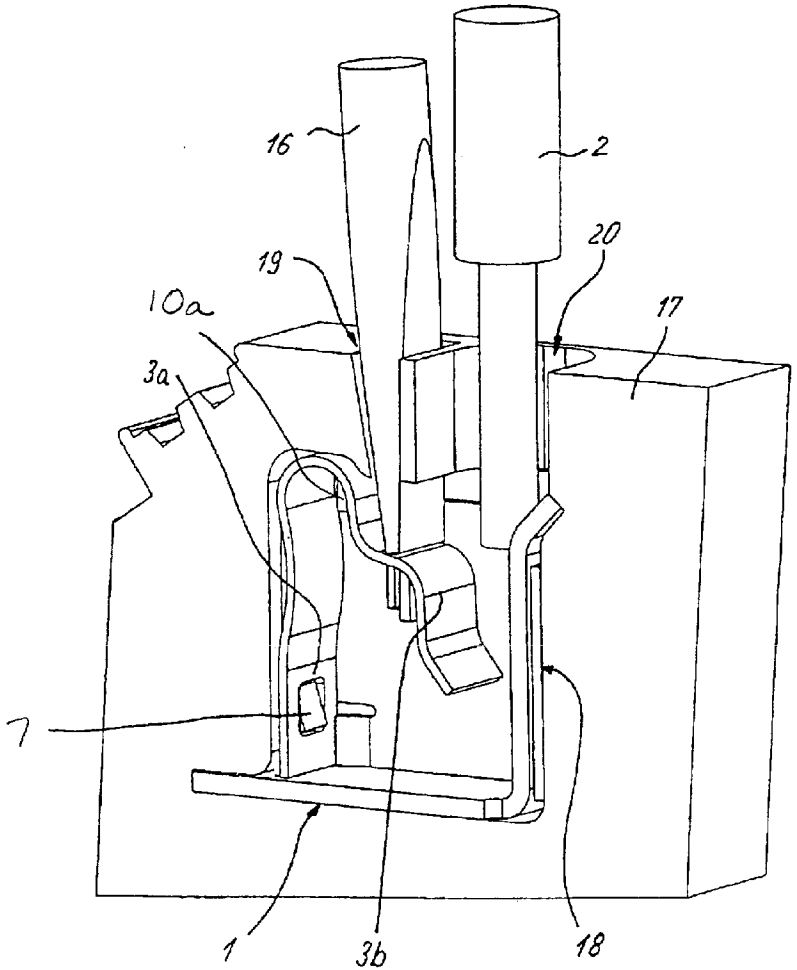
FIG. 1*f* is a perspective side elevation view illustrating the apparatus of FIG. 1*e* contained in the cavity of a terminal block formed of electrical insulating material.

FIG. 1*c* shows an individual view of the bus bar and the resilient contact 3 in the open state for purposes of connection (but for the sake of clarity without the conductor). Here, contact leg 3*b* rests against projection 11. For assembly, bus bar 4 can be pushed into metal housing 5*b*, for example, in the opened state from underneath.

FIG. 1*d* shows how the connecting device performs after insertion of a conductor 2. As one can see, contact leg 3*b* rests against projection 11 so that a particularly defined clamping force is exerted upon the conductor that presses the conductor against bus bar 4.

Figure 1E:
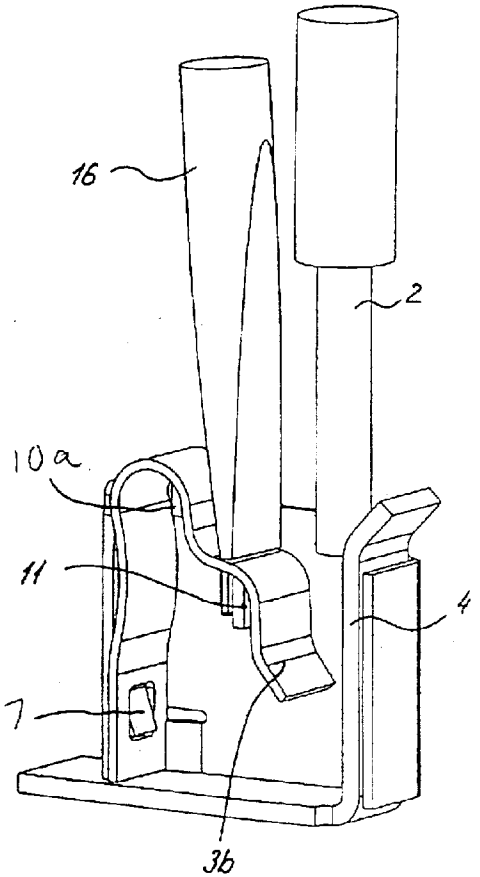
FIG. 1*e* illustrates the release of the resilient contact from the conductor by means of the tip of a screwdriver.

FIG. 1*e* shows that there is enough space next to the conductor in order by means of an actuating tool, in particular, a screwdriver 16, to press contact leg 3*b* against projection 11 to release conductor 2. This kind of actuation is not absolutely necessary during the insertion of the conductor; instead, it is also possible to insert the in this case particularly suitable single-wire conductor 2 or a fine-wire conductor with crimped-on lead end sleeve into connecting device 1 by simply inserting it in.

FIG. If shows the integration of connecting device 1 in a terminal housing 17, which has a recess 18 as well as insertion openings 19, 20 for screwdriver 16 or some other kind of actuation tool and conductor 2. With the help of the screwdriver, it is, in particular, possible to press the terminal leg 3*b* practically and reliably down in the wave-shaped area and to open the clamping point of connecting device 1. By virtue of the shape of the resilient contact and the shape of metal housing 5 as well as the screwdriver guide (opening 19) in the terminal, one can prevent conductor 2 from being obstructed by the screwdriver.

Figure 1H:
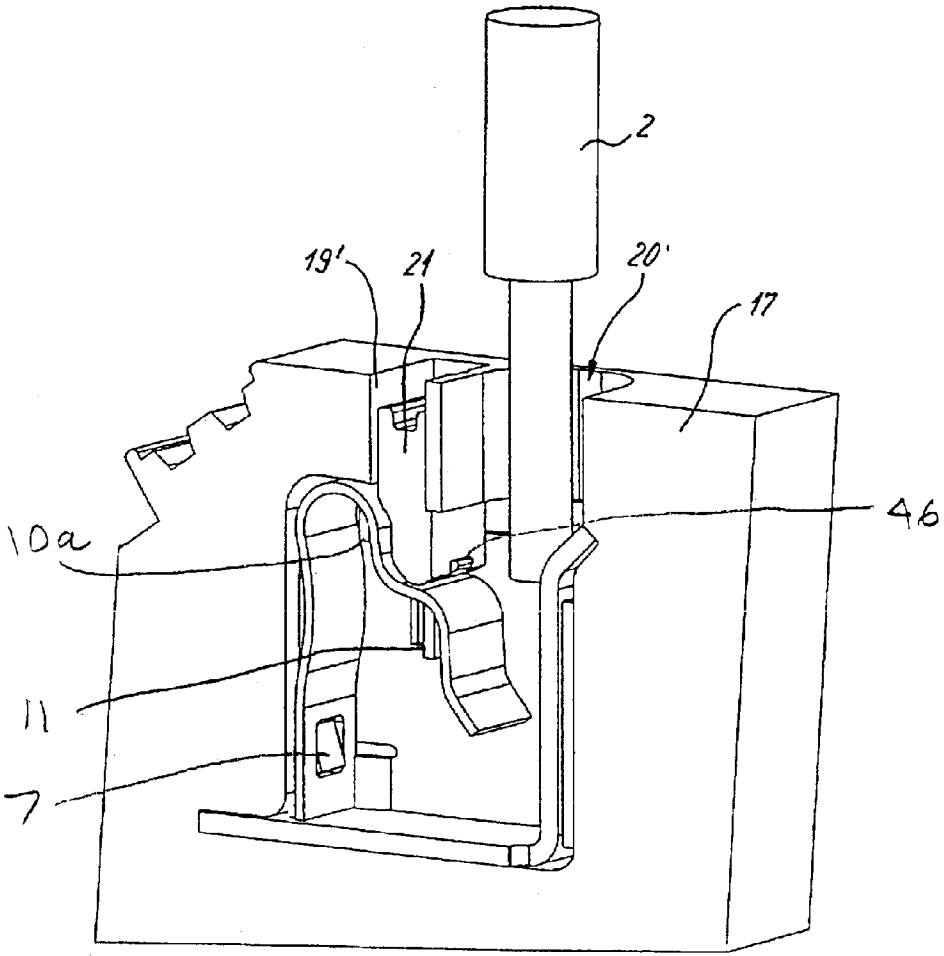
FIGS. 1*g* and 1*h* illustrate a modification including an auxiliary slidably mounted disengagement piece for disengaging the resilient contact leg from the conductor.
Figure 1G:
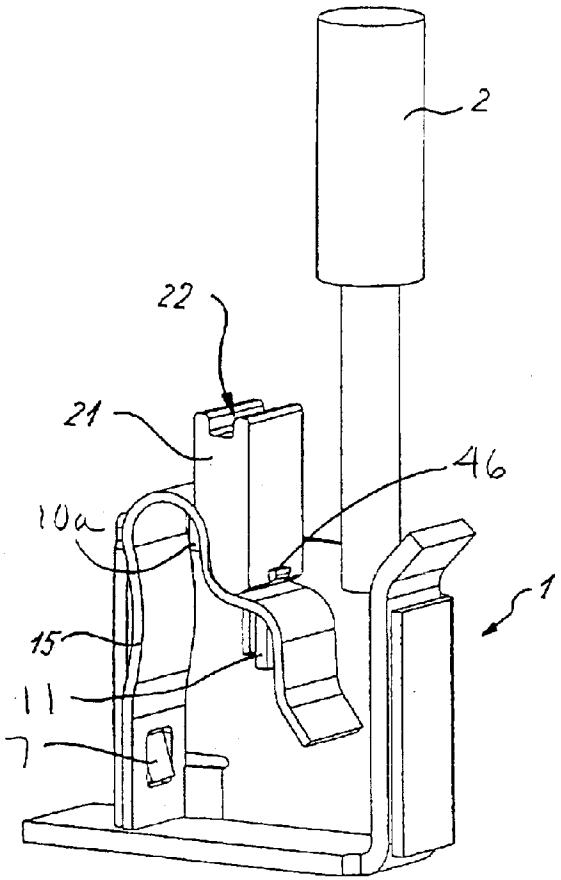

FIG. 1*g* shows an alternate embodiment where an auxiliary actuation member 21 rests on the terminal leg 3*b*, which is bent in serpentine form, which member includes on one of its top sides a notch or a slit 22 for the placement of the screwdriver and which on one side has a catch nose 46 as a dropout safety so that it will not fall out of the terminal housing.

As one can see in FIG. 1*h*, actuating piece 21 is slidably guided for movement in a correspondingly shaped recess 19' and can facilitate a particularly defined and reliable actuation of the connecting device.

Figure 11:
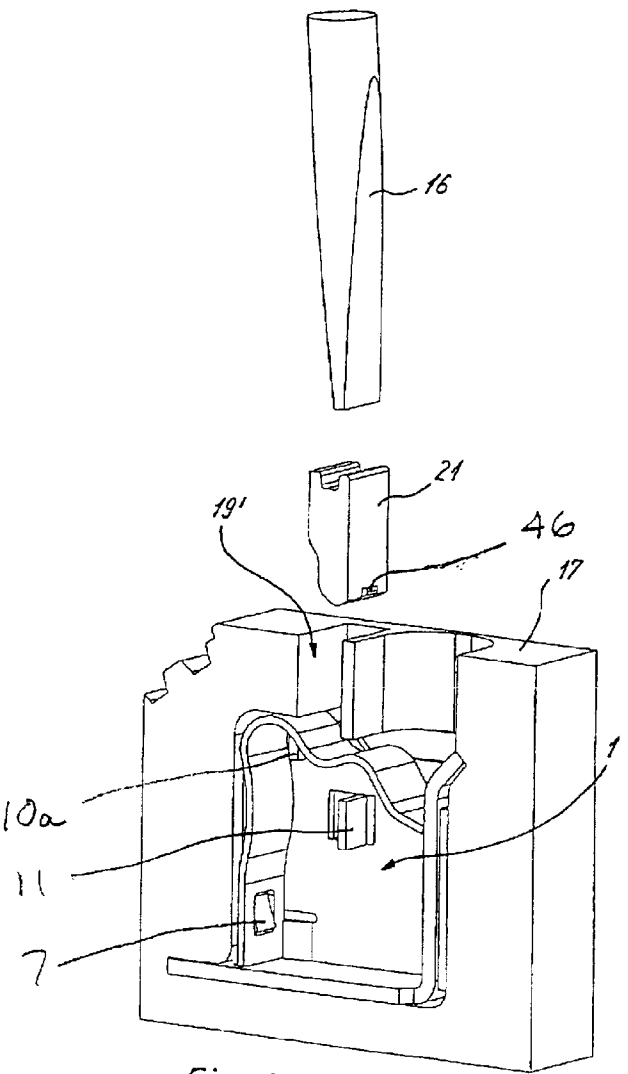
Figure 11:
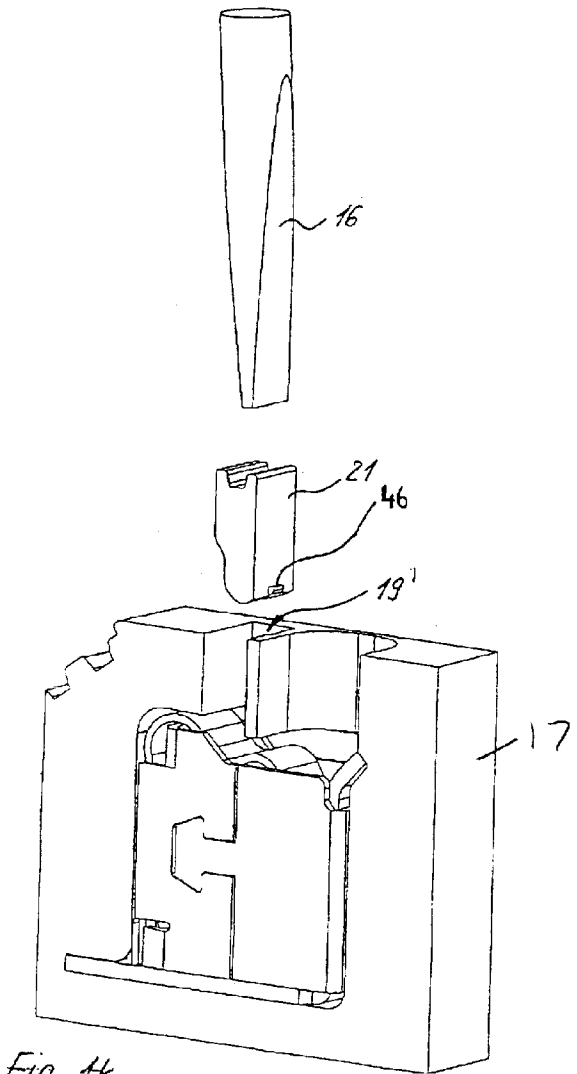

As one can see in FIG. 11, it is also possible to attach the bus bar, for example, directly on another bus bar 44, where the bus bar 4 will not then have an L shape that is to say, it will not have a second leg 4*b*.

Figure 1J:
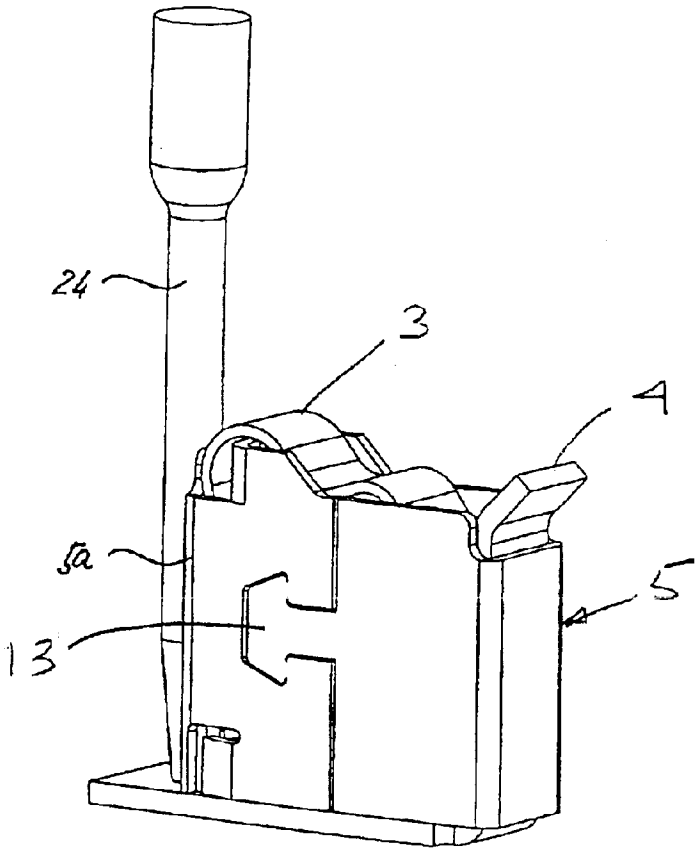
FIG. 1*j* is a modification illustrating the insertion of a test probe for engagement with the metal housing.
Figure 1I:
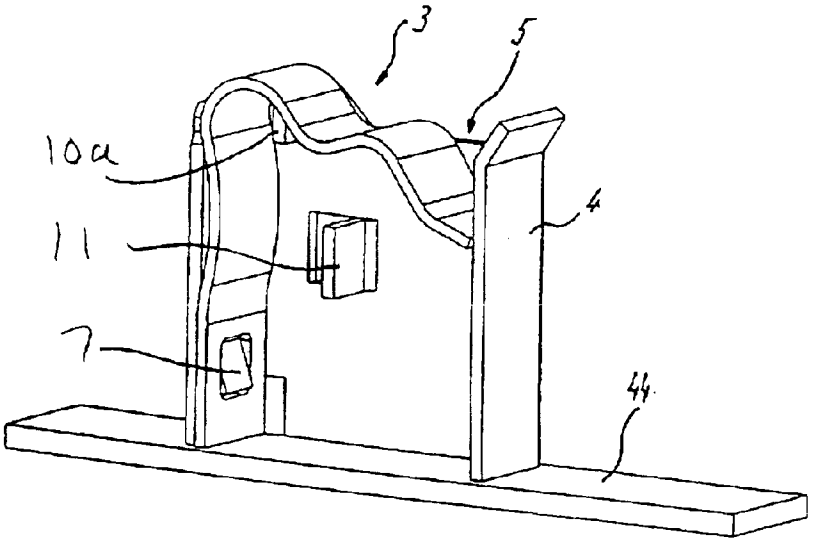
FIG. 1*i* is a perspective view illustrating a modification of the bus bar means of FIG. 1*b*.

FIG. 1*j* shows that one can put a test tap 24 in the most varied places of the connecting device, for example, on an outer side, for example, outside upon the first end wall 5*a*.

Just as FIG. 11, FIG. 1*k* illustrates the insertion of an actuation piece 21 into opening 19' of terminal housing 17. Catch nose 46 here prevents the actuation piece against falling out of the terminal block.

Figure 1N:
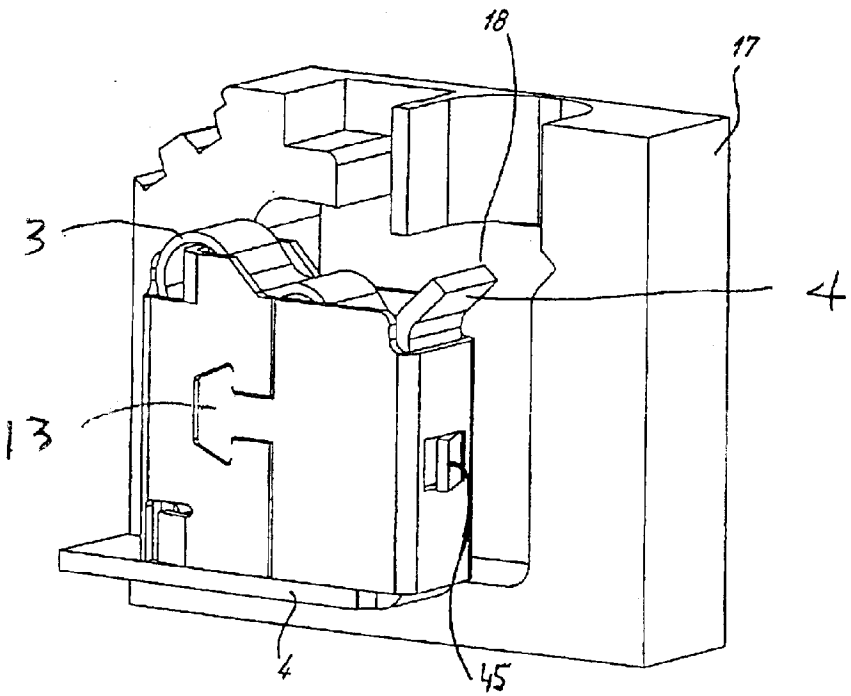
FIG. 1*n* illustrates a modification of the apparatus of FIG. 1*j*.
Figure 1M:
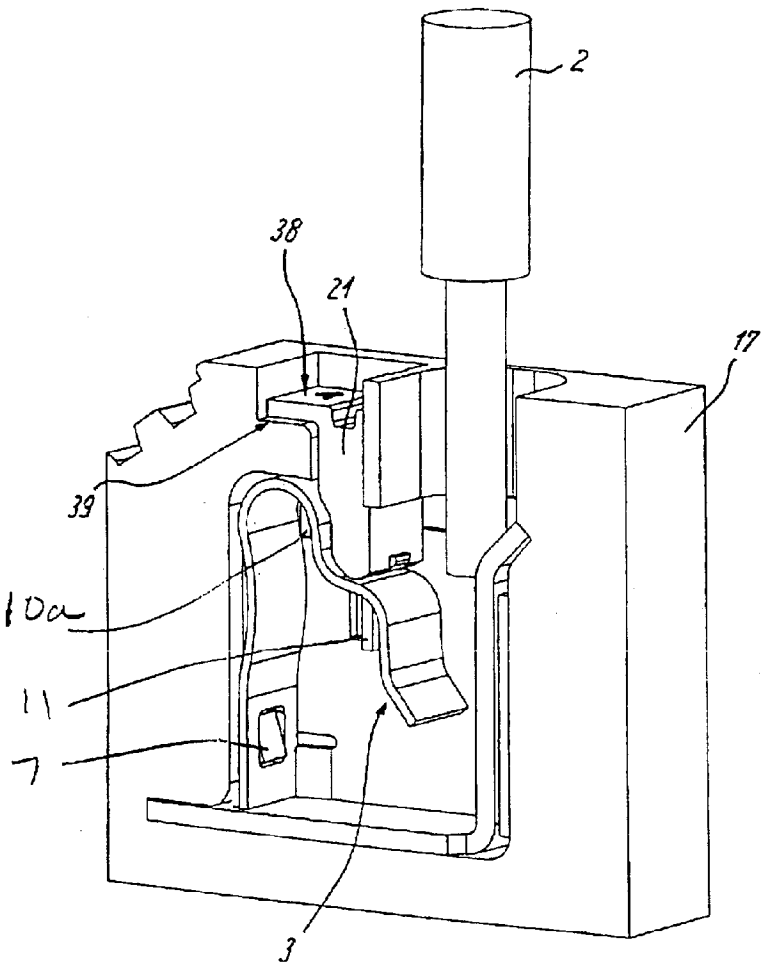
FIG. 1*m* illustrates a modification of the apparatus of FIG. 1*h;*

FIG. 1*m* shows that the top of actuation piece 21 can be made widened in such a manner that there will be formed a marking area 38 for the attachment of a marker. A corresponding recess 39 is provided in terminal housing 17 to receive the marking area 38.

FIG. 1*n* illustrates the assembly or insertion of connecting device of FIG. 1*a* with bus bar 4 from the side into the rather plain-shaped, generally rectangular recess 18 of terminal housing 17, where the connection device 1 with a projection 45 that is bent directly out of the outside of metal housing 5 is retained reliably in a recess of the terminal block so that it will be secured against falling out sidewards.

Figure 1O:
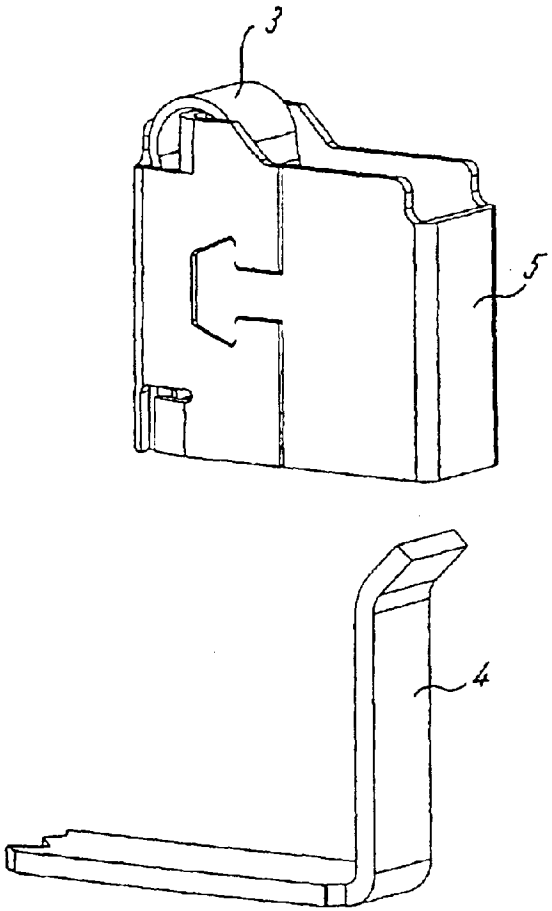
FIG. 1*o* is an exploded view illustrating the configuration of the bus bar of FIG. 1*a* relative to its housing.

FIG. 1*o* shows the resilient contact 3 in the upper part, along with metal housing 5 and, in the lower part, the L-shaped bus bar 4 by way of an individual illustration.

Figure 2A:
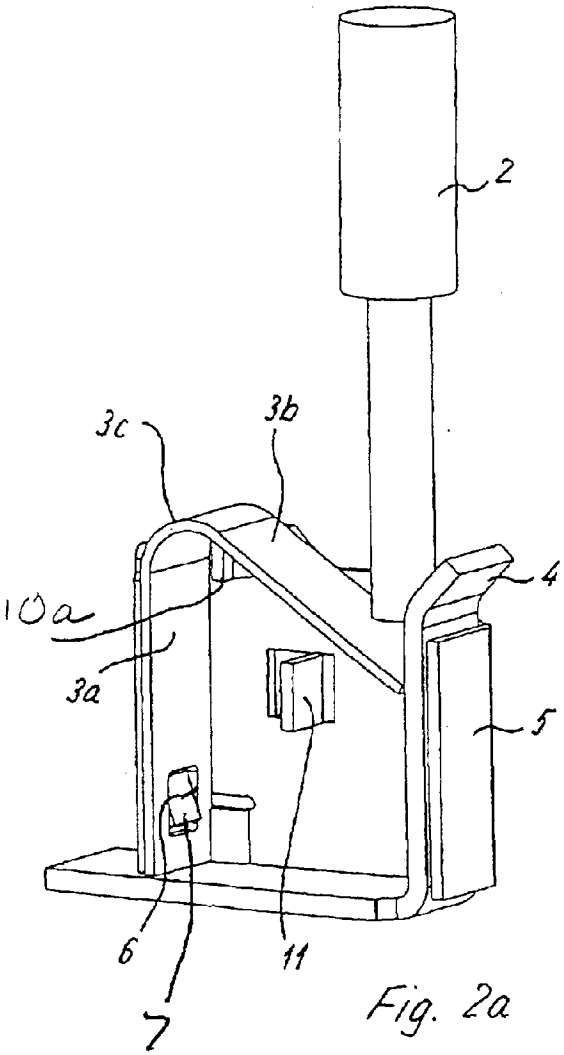
FIG. 2*a* is a perspective view illustrating a modification of the apparatus of FIG. 1*b*, and FIG. 2*b* illustrated the release operation of the apparatus of FIG. 2*a;*
Figure 2D:
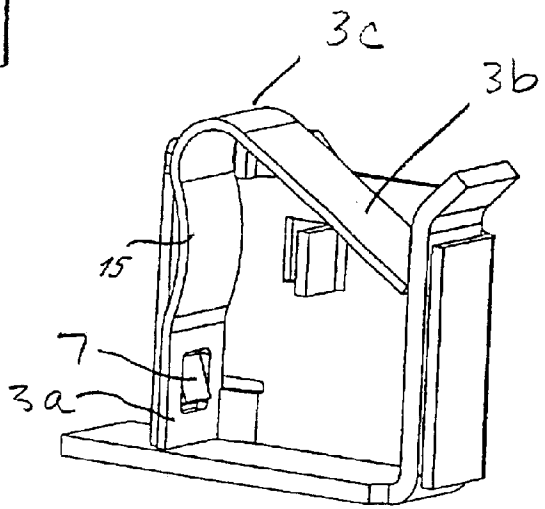
FIGS. 2*c*, 2*d*, 2*e* and 2*f* illustrate modifications of the apparatus of FIG. 2*a;*

The exemplary embodiment in FIG. 2*a* extensively corresponds to the exemplary embodiment illustrated in FIG. 1. Of course, here, the second terminal leg 3*b* is not made with a corrugated shape but rather in a planar manner so that no support surface is made here for screwdriver 16. The variant nevertheless functions well if in the manner of FIG. 2*b* the insertion opening 19 for screwdriver 16 is made tapering in the direction of insertion so that the insertion movement of screwdriver 16 into terminal housing 17 will be limited.

Figure 2C:
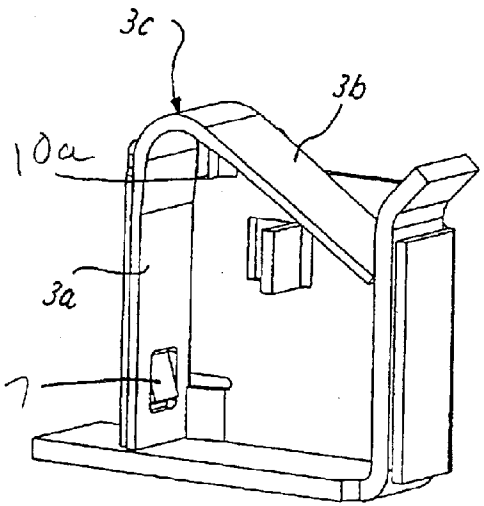
Figure 2B:
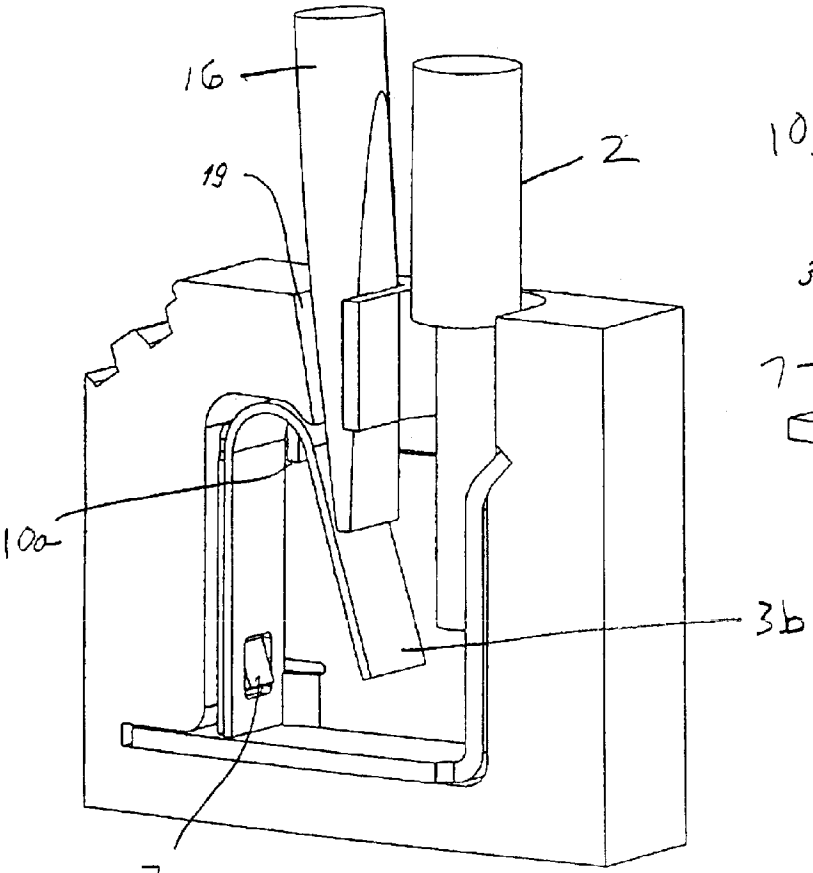
Figure 2E:
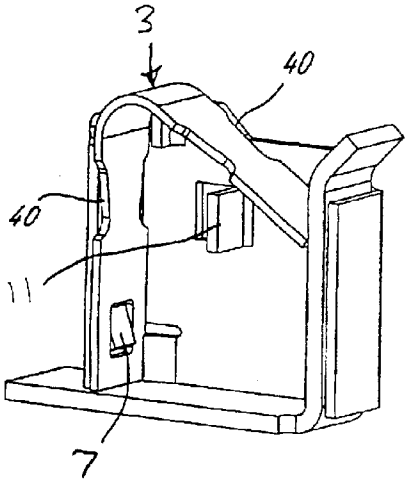
Figure 2F:
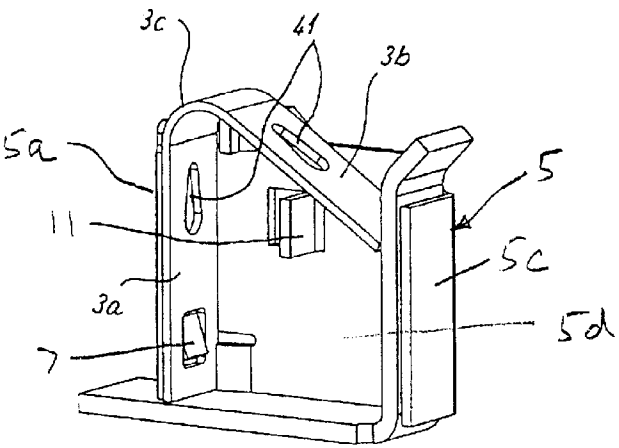

To bring about a defined tension state, it is provided according to the variants in FIG. 2*c* that the resilient contact be made thickened in the sector of the bend or in the bending sector 3*c*. This effect is achieved in FIG. 2*d* by means of the outward bulge 15 in the first longitudinal leg, and in FIG. 2*e* it is achieved by a taper 40 in the area of the first and the second terminal legs in each case on both sides of the terminal legs adjoining the bending portion 3*b*. FIG. 2*f* shows the establishment of the defined tension state by two drop-shaped borehole-like openings 41 in the middle of contact legs 2*a* and 2*b*.

Figure 3A:
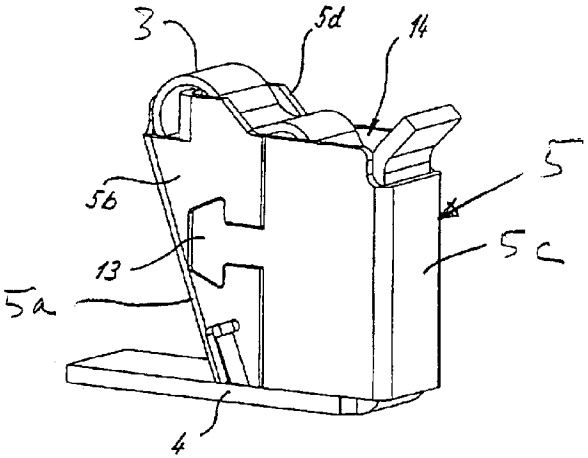
FIGS. 3*a* and 3*b* are perspective views of a first modification of the apparatus of FIG. 1*a*, and FIGS. 4*a* and 4*b* are perspective views of a second modification.
Figure 3B:
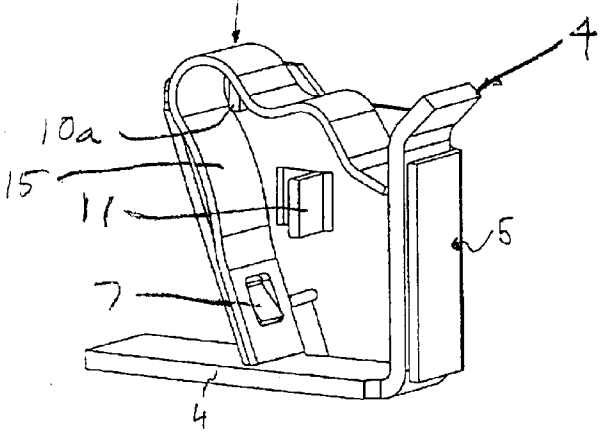

FIG. 3 shows a variant where the metal housing or the metal housing 5 is tapered unilaterally downward (in the area of side walls 5*b* and 5*d*) from insertion side 14 toward bus bar 4. Accordingly, of course, the cross-section of metal housing 5 continues to be rectangular. The cross-section, however, is also tapered in the direction of insertion. Here, one can bring about a particularly compact structured connecting device whose structure, however, otherwise corresponds to the exemplary embodiment in FIG. 1.

In FIG. 4, it is even provided that the terminal housing be tapered on both sides, that is to say, side walls 5*b* and 5*d* in each case are trapezoidal, something which, compared to FIG. 3, saves more space and is more compact.

Figures 4A, 4B, 5A, 5B:
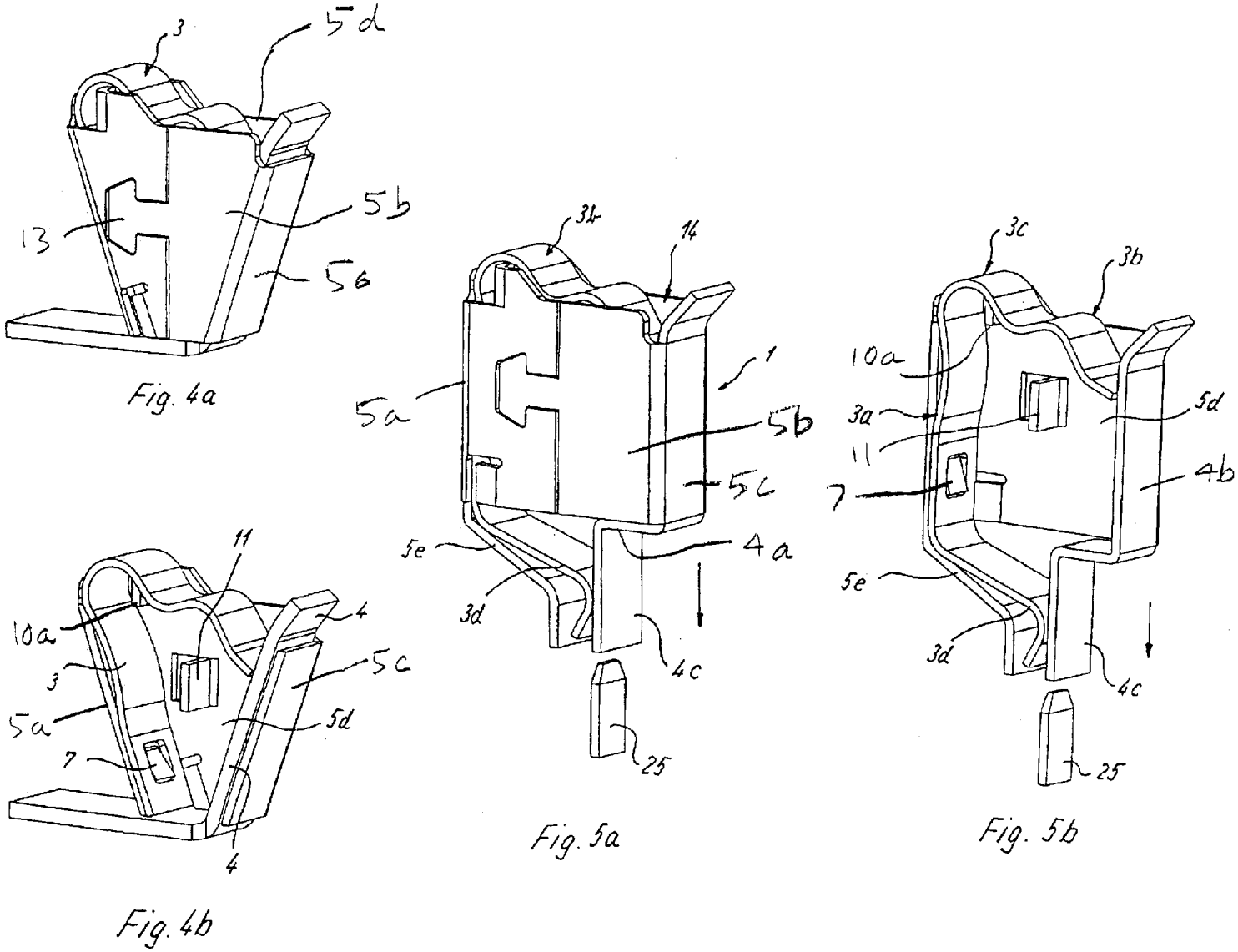
FIGS. 5*a* and 5*b* are perspective views of a modification having auxiliary tap connector means.

According to FIGS. 5*a* and *b*, there is molded upon the side of connecting device 1 opposite insertion opening 14 against metal housing 5 upon resilient contact 3 and upon bus bar 4 one each additional leg 5*e*, 4*c* and 3*d*, which are bent toward each other, where between spring leg 3*d* and bus bar leg 4*c* of bus bar 4, there is a connection possibility for a pin plug 25. Leg 5*e* of the metal housing here serves as stop for the movement of contact leg portion 3*d*.

Figure 6B:
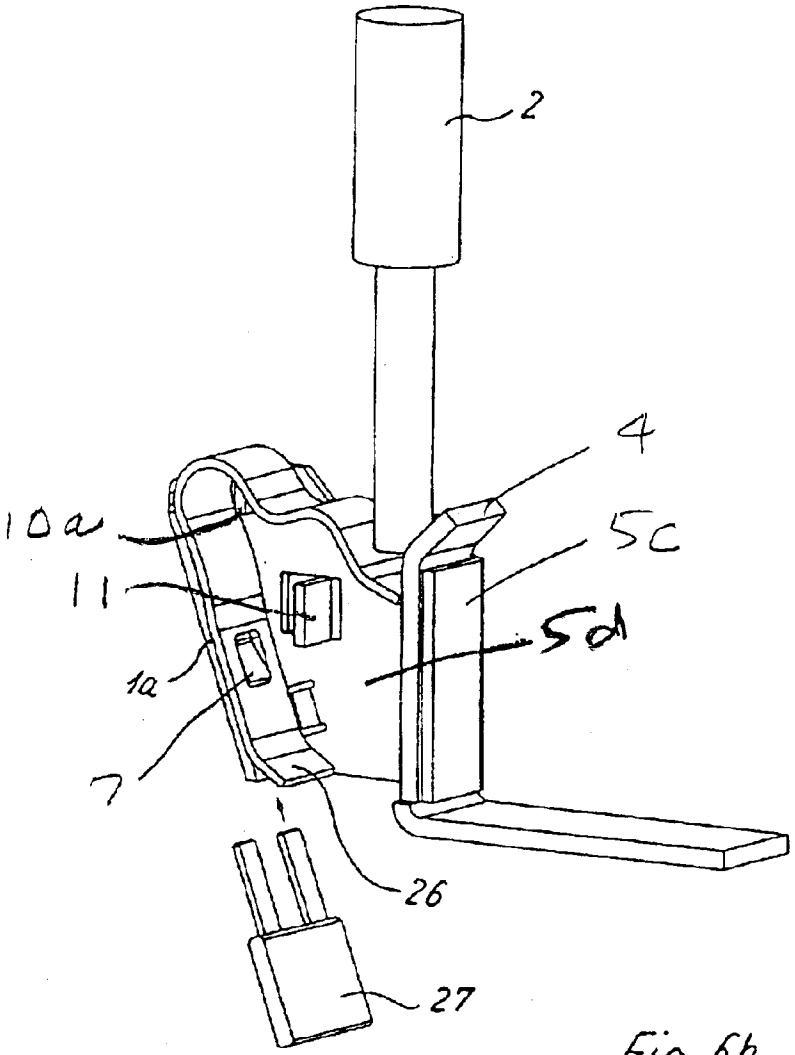
FIGS. 6*a* and 6*b*, FIGS. 7*a* and 7*b*, and FIGS. 8*a* and 8*b* are a first test plug or auxiliary connector modification of the apparatus of FIG. 5*a*, and FIGS. 9*a* and 9*b*, 10*a* and 10*b*, 11*a* and 11*b* illustrate a second test plug or auxiliary connector modification of the apparatus of FIG. 5*a;*
Figure 6A:
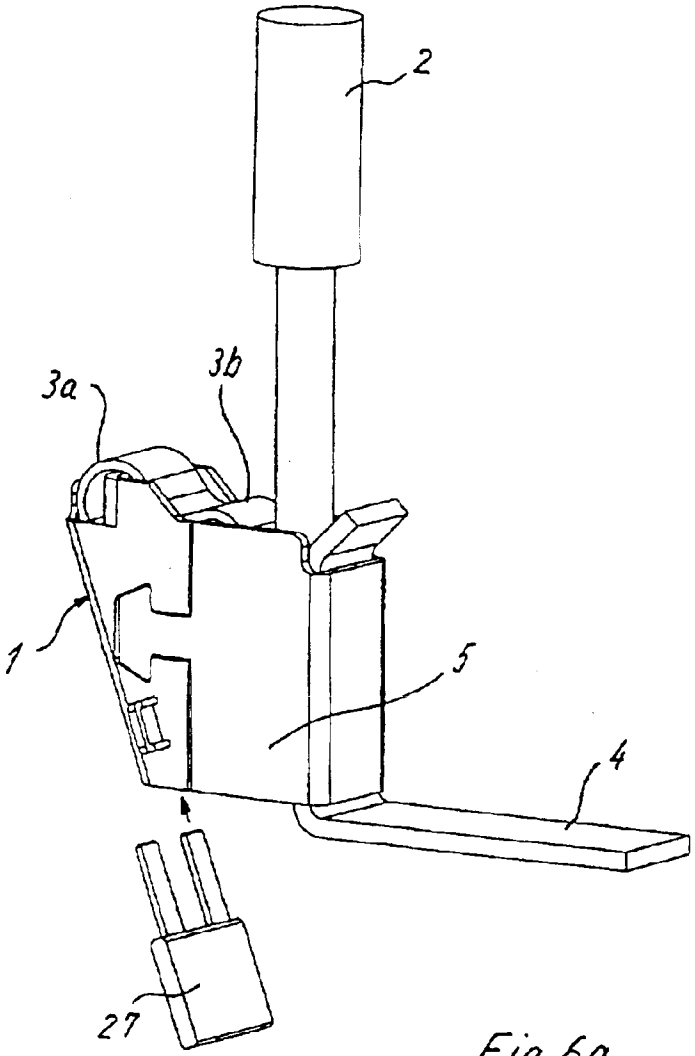

FIGS. 6*a* and 6*b* illustrate that, looking at a corresponding variant of bus bar 4 which does not close off the side of the metal housing 5 positioned opposite insertion opening 14, the area between one bent end 26 of the first leg 3*a* and of the first end wall 5*a* can be used as plug possibility for a test tap or for a cross-connector 27.

Figure 7B:
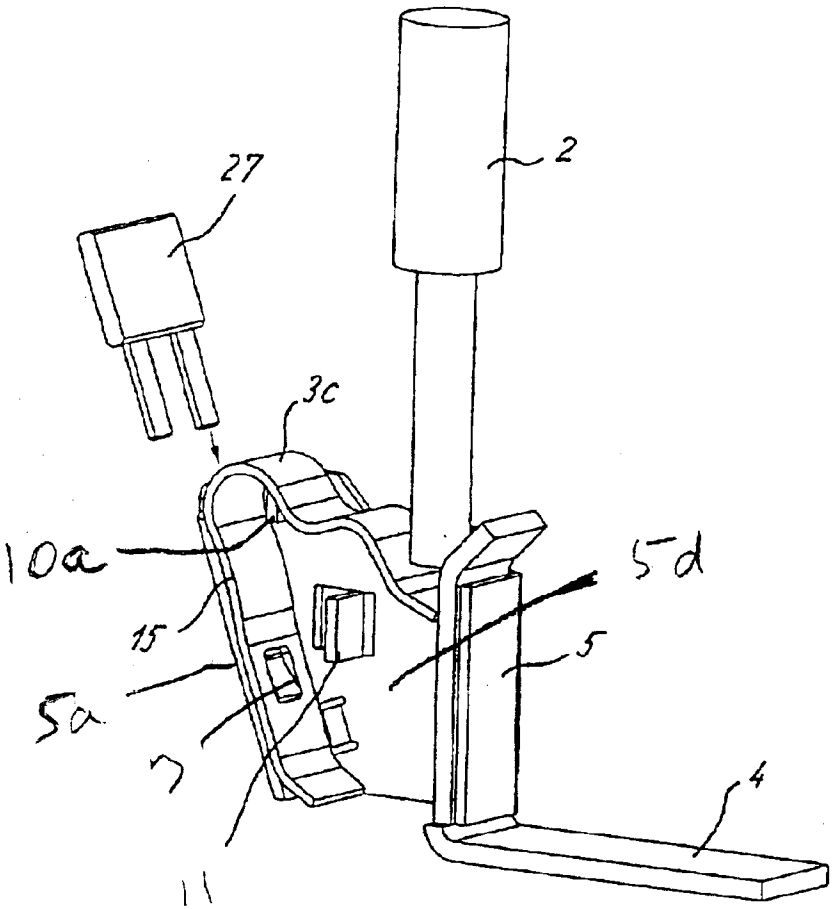
Figure 7A:
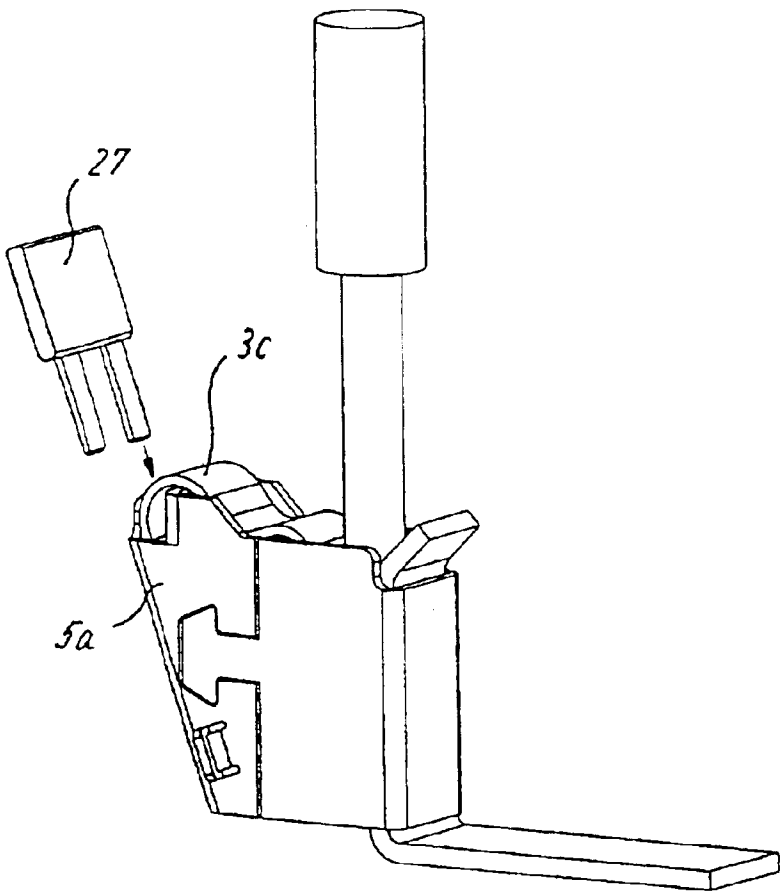

FIG. 7*a* shows that one can insert—also between bending sector 3*c* and the first end wall 5*a*—such a cross-connector 27 or a test plug.

Figure 8B:
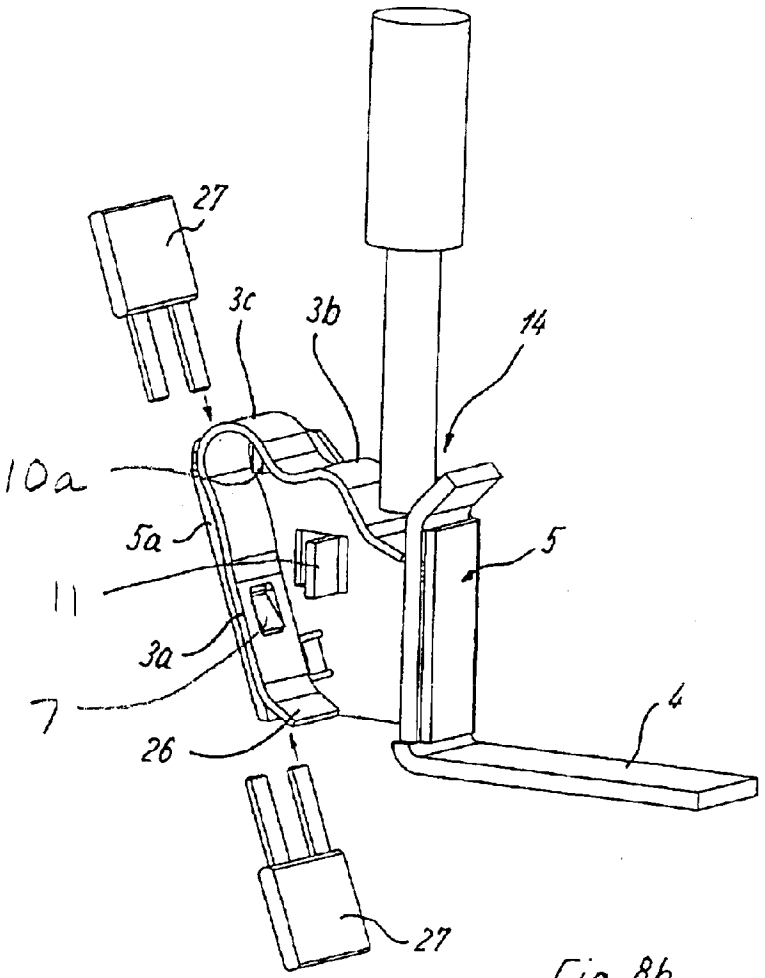
Figure 8A:
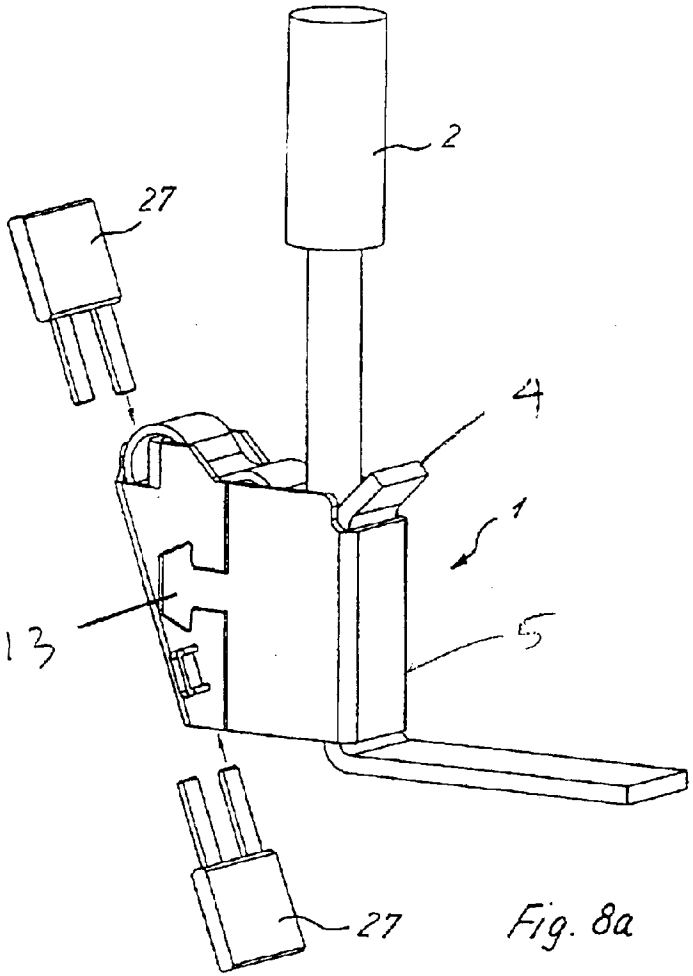

FIG. 8 combines the variants from FIGS. 6 and 7 and facilitates the engagement of cross-connectors 27 or test plugs, both according to the manner shown in FIG. 6 and according to the manner shown in FIG. 7.

Figure 9B:
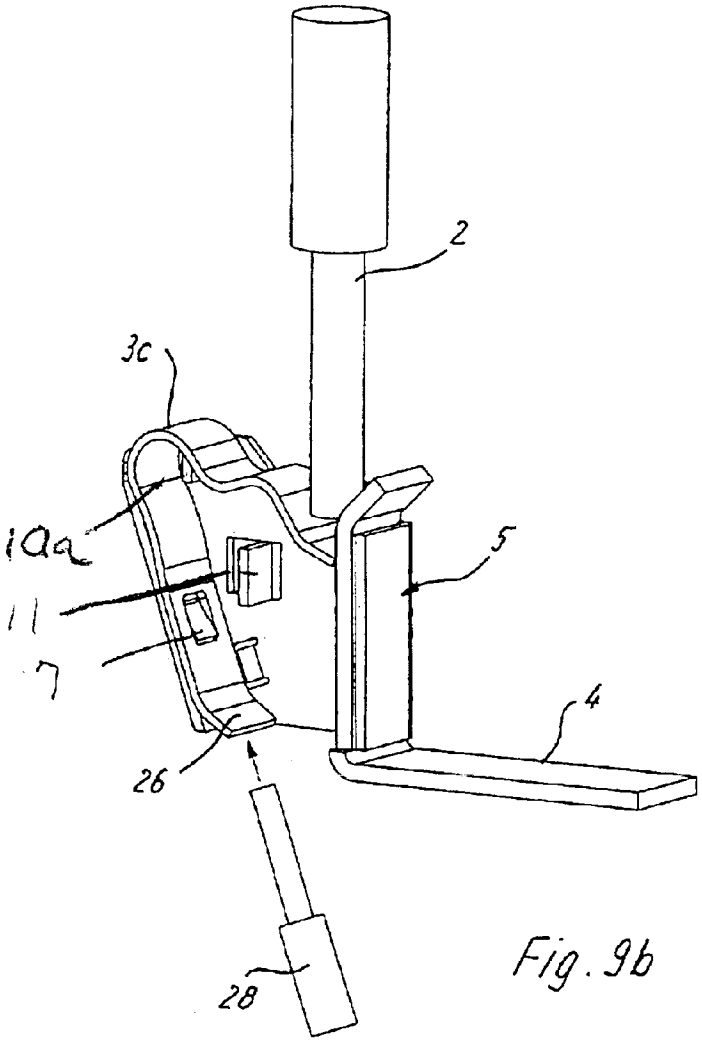
Figure 9A:
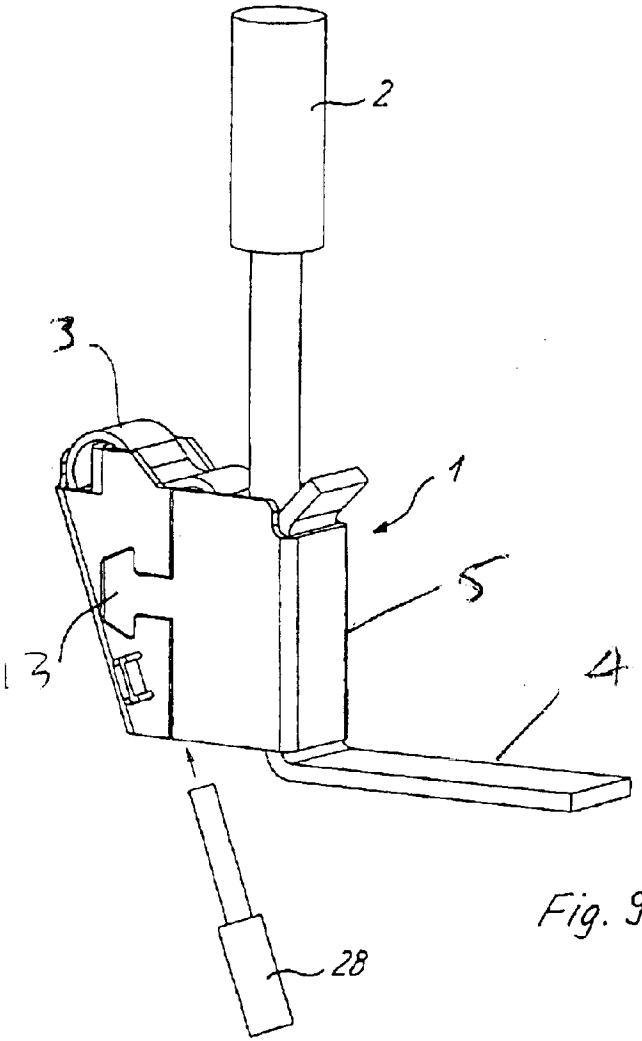

FIG. 9 illustrates that the embodiments according to FIG. 6 can also be used for the insertion of an additional conductor 28 instead of for the insertion of a cross-connector 27.

Figure 10B:
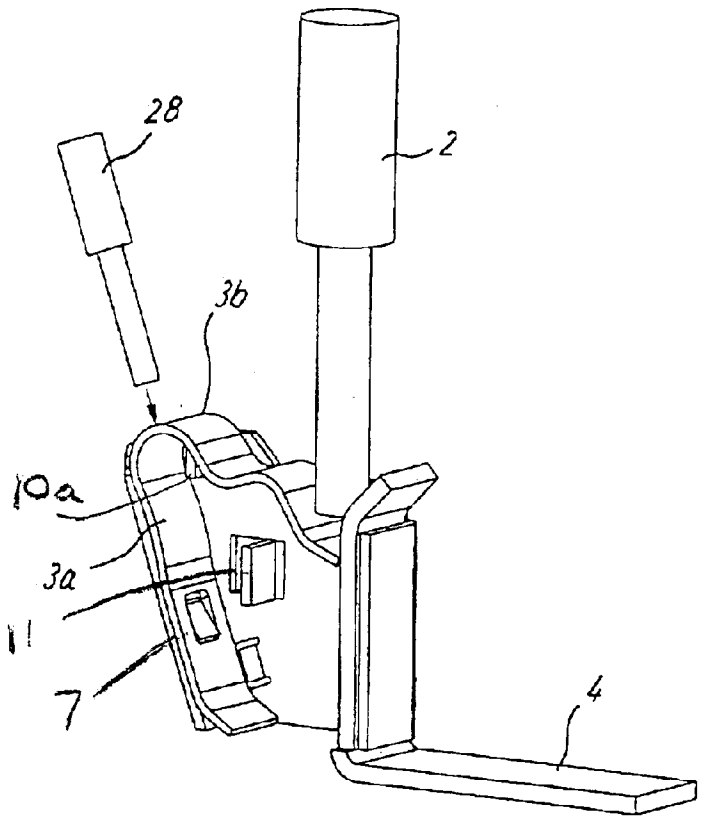
Figure 10A:
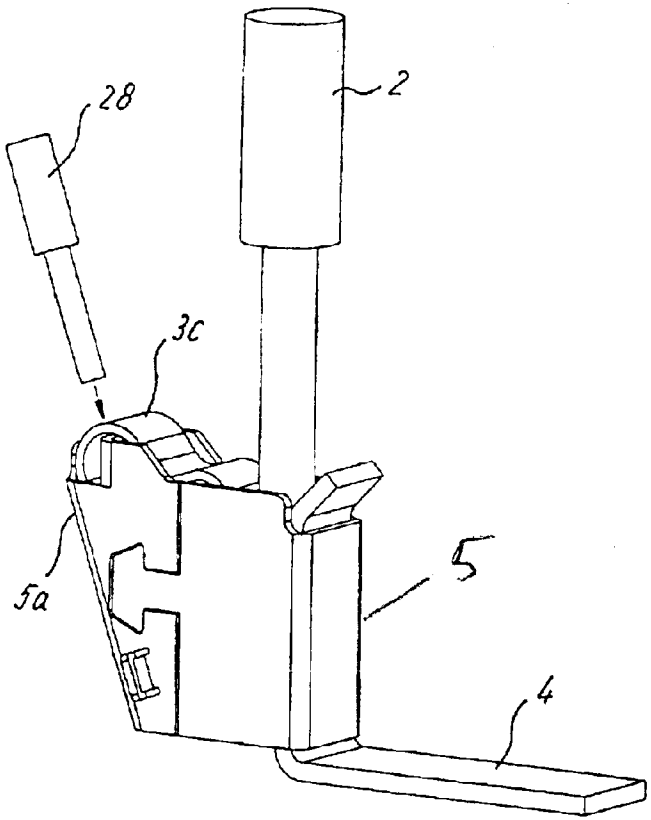
Figure 11B:
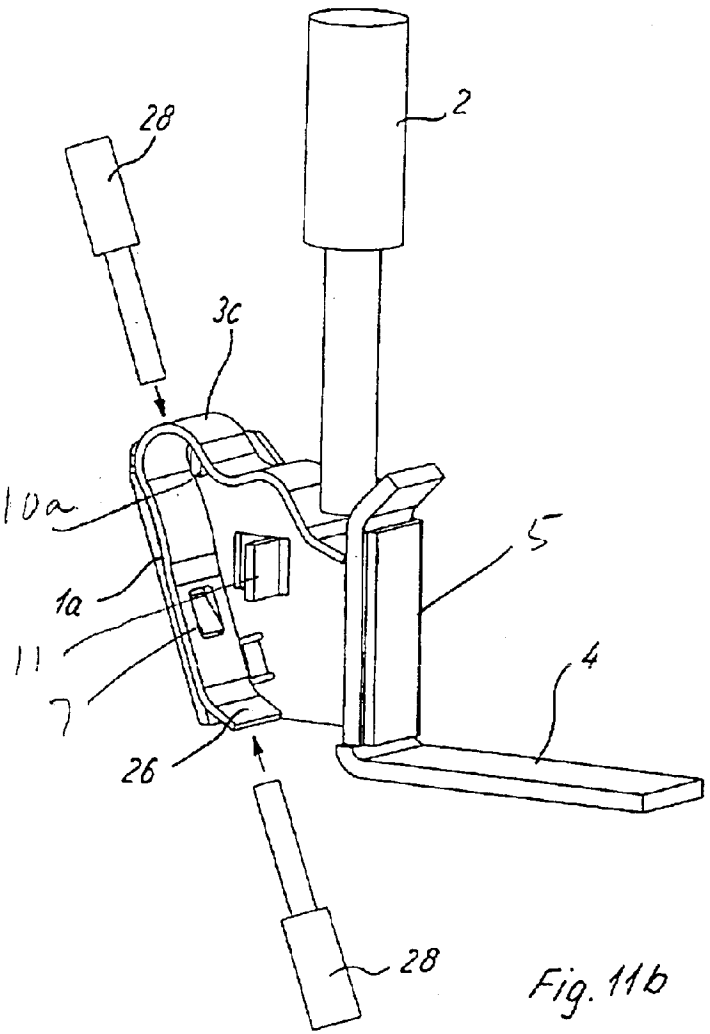
Figure 11A:
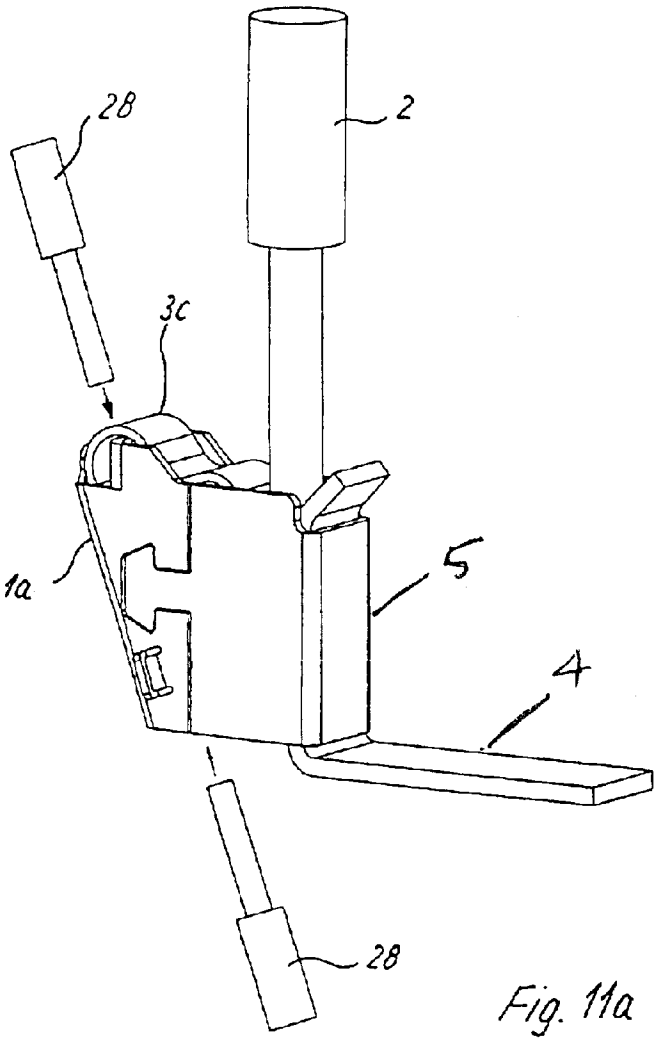

In a similar manner, FIG. 10 shows the insertion of an additional conductor 28 between the bending sector 3*c* of the resilient 3 and the first end wall 5*a*.

FIG. 11 combines the variants from FIG. 9 and FIG. 10, that is to say, conductors 28 are stuck both in the direction of insertion between bending sector 3*c* and the first side wall 1*a* and also on the opposite side between the bent end 26 and side wall 1*a*.

Figure 13:
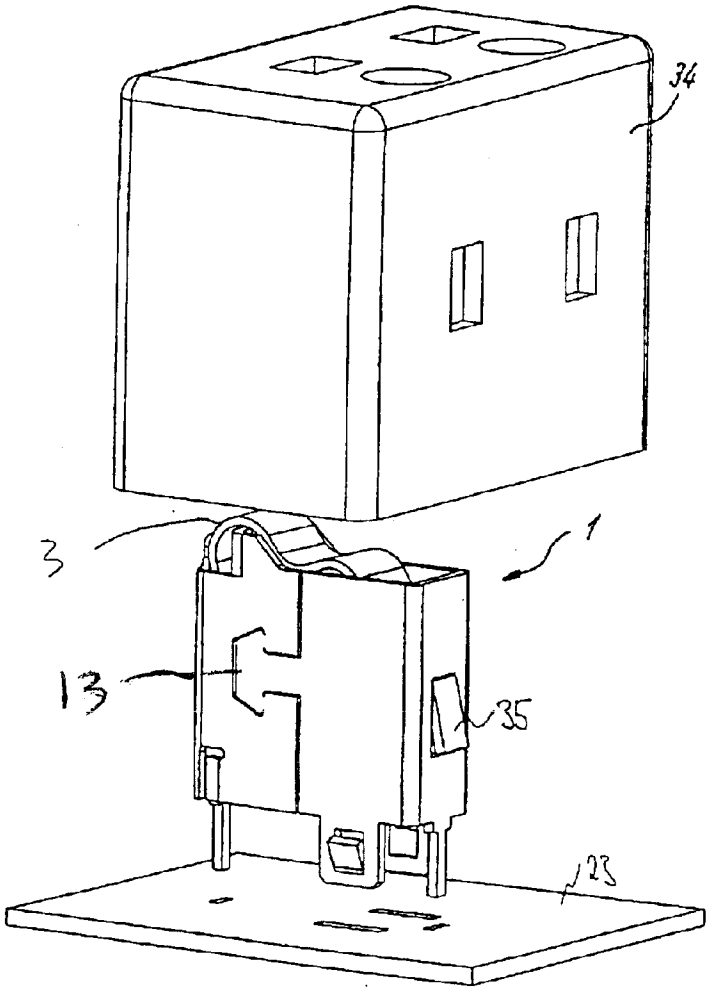
FIGS. 12, 13, 14 and 15 illustrate a modification in which the metal housing is provided with soldering lugs for connecting the housing to a printed circuit board.
Figure 12:
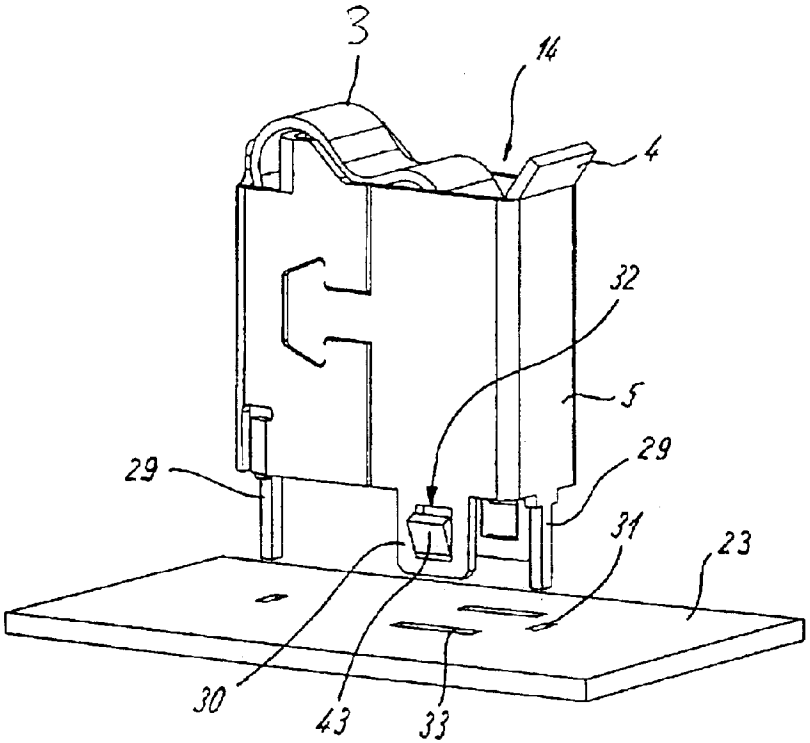

FIG. 12 illustrates that small soldering or insertion mounting legs 29 can be molded directly upon the ends of metal housing 5, which ends are located opposite insertion opening 14, which small legs can be inserted into a printed circuit board 23 or openings 31 of the printed circuit board 23 and can be soldered there, can be pressed there or can be riveted there. According to FIG. 12, along with the soldering legs, there are also plugging legs 30 with protrusions 43 that bring about undercuts 32 which—when stuck through corresponding slits 33—can be made to catch on printed circuit board 23. An outer housing 34 (FIG. 13) can be stuck over one or several of these connecting devices. This outer housing 34 can, for example, consist of an insulation substance.

Figure 14:
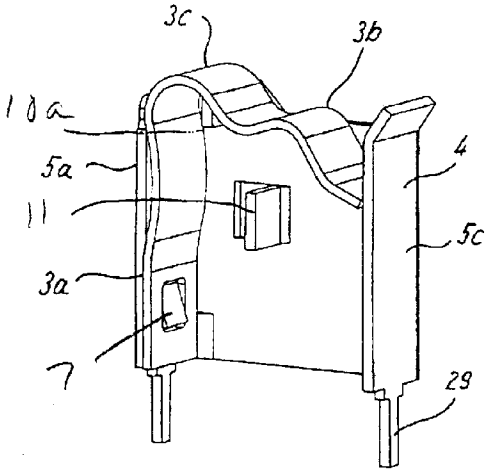

FIG. 14 illustrates that bus bar 4 formed integrally with the metal housing, for example, it can form a part of the metal housing if said housing is made up of well-conducting material.

Figure 15:
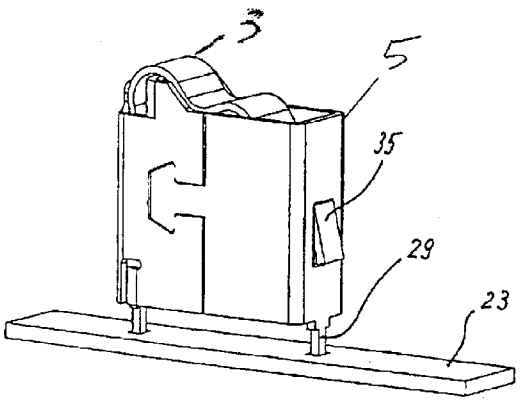

FIG. 15 shows another variant that can be soldered upon a printed circuit board 23 with soldering legs 29 and a projection 35 for firmly catching an over-insulation-material housing upon one of the side walls of metal housing 5, which also assumes a conducting function as a bus bar.

Figure 16:
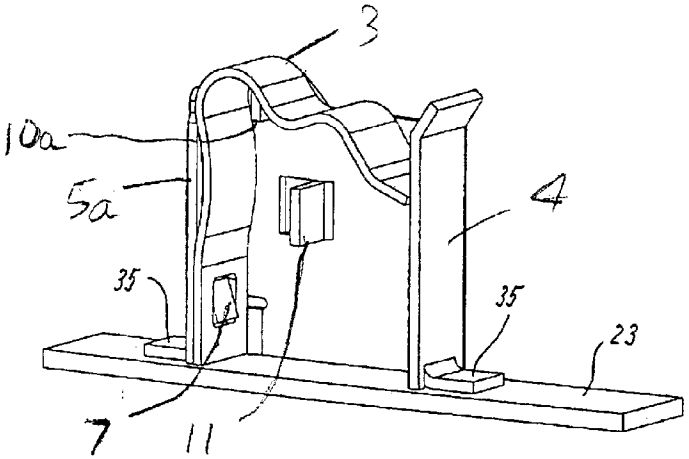
FIGS. 16 and 17 illustrate a second method including fastening pieces for connecting the housing to a printed circuit board.
Figure 17:
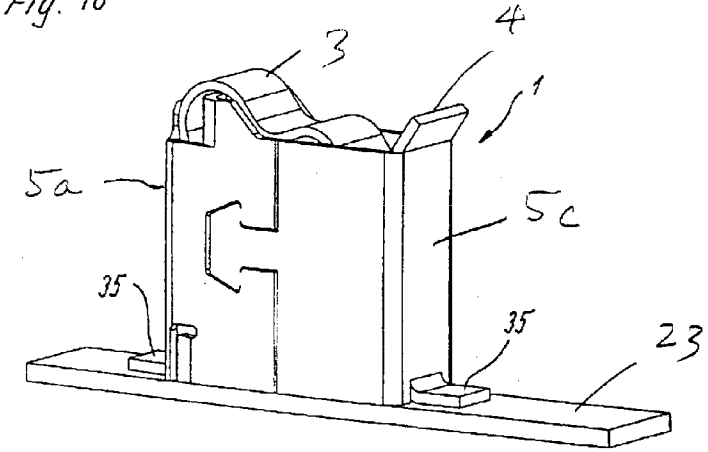

FIGS. 16 and 17 show that, instead of soldering legs 29, one can use SMD-like fastening pieces 35 to get an SMD-like attachment upon the printed circuit board (see also FIG. 17).

Figure 18B:
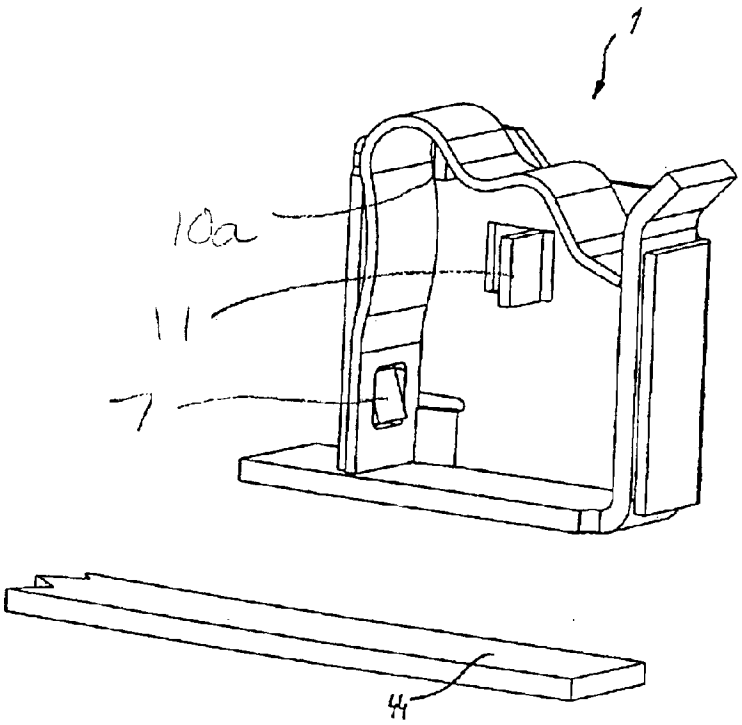
Figure 18A:
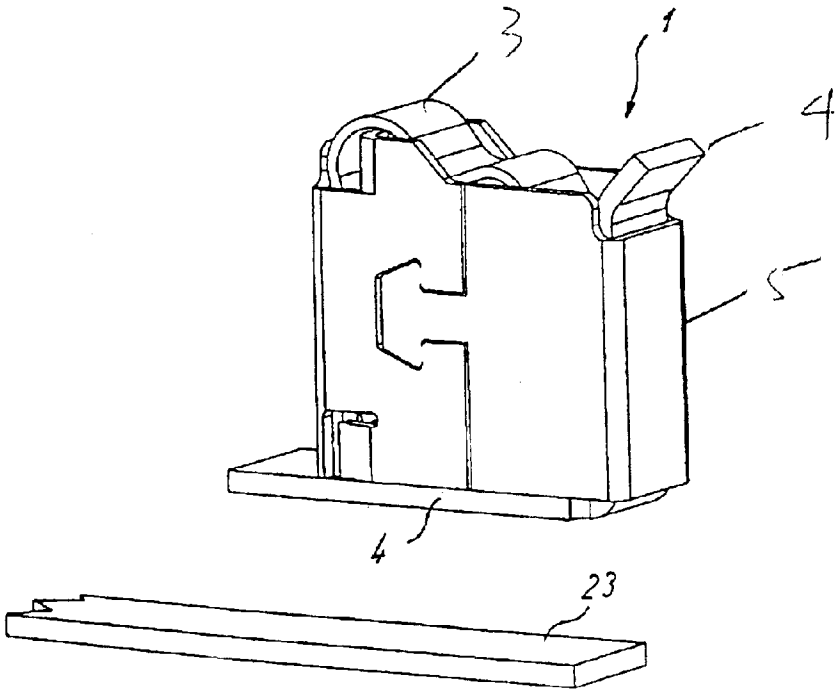

FIGS. 18*a* and 18*b* show that the connecting device according to FIG. 1*a* can also be adhered to a printed circuit board or upon a bridge or a bus bar 41.

Figure 20:
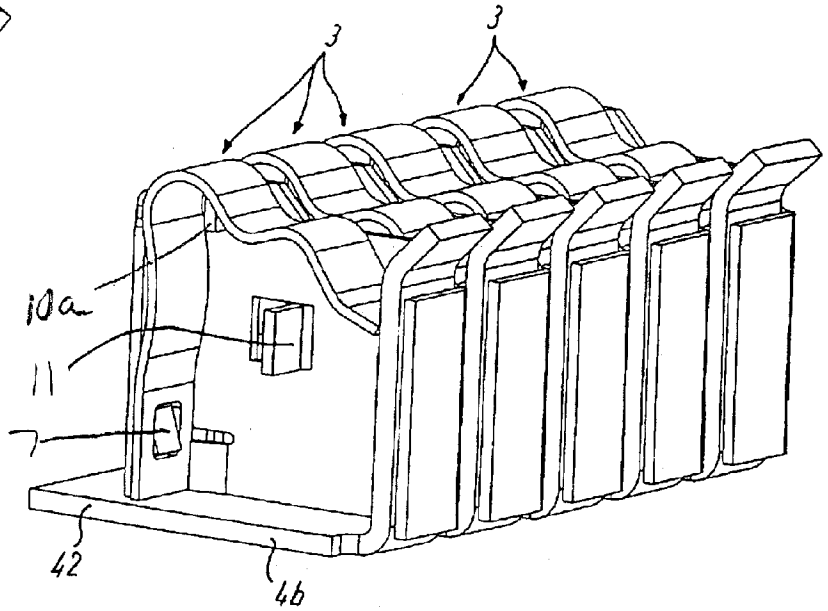
FIGS. 19–21 are perspective views illustrating a stack of the electrical connectors provided with a common bus bar.
Figure 19:
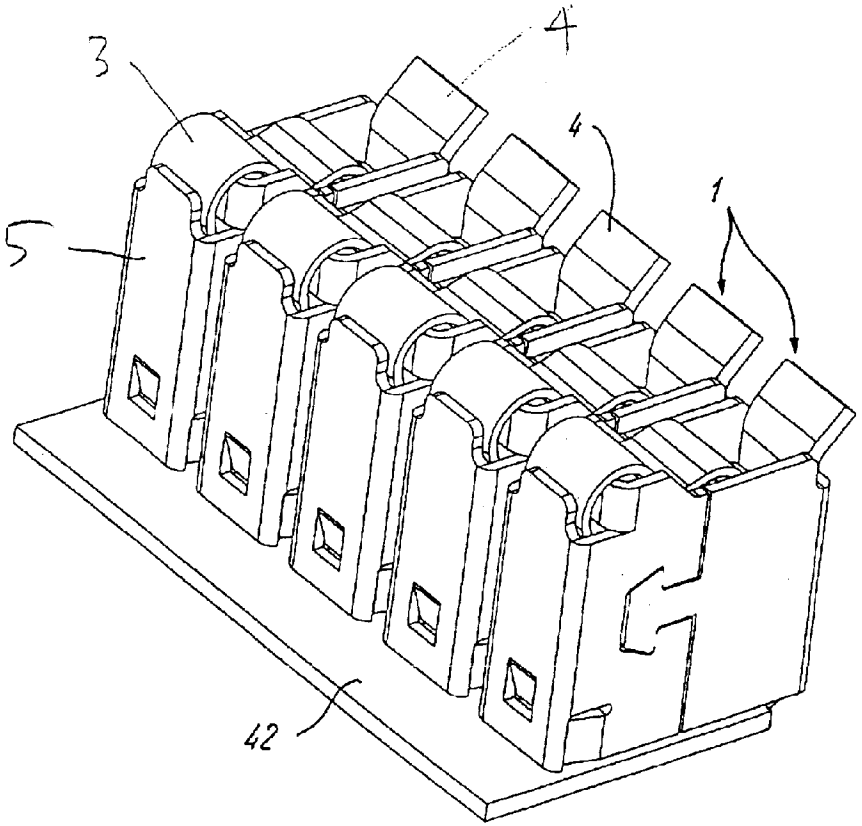
Figure 21:
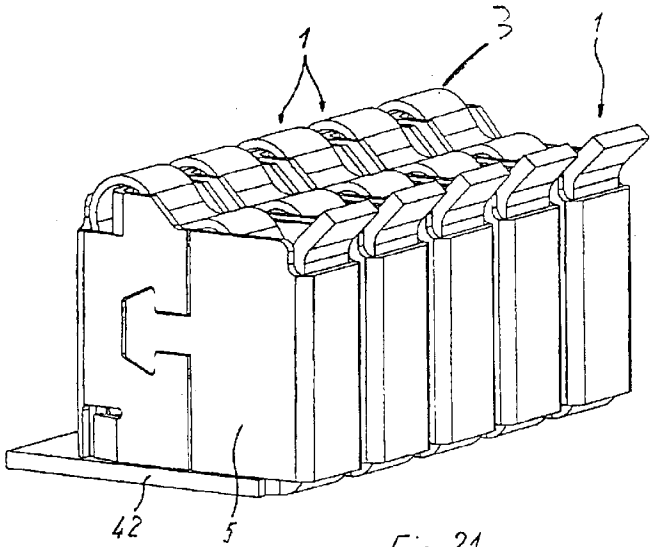

FIGS. 19–21 show several connecting devices lined up on a printed circuit board, where the second longitudinal legs 4*b* of the bus bars 4 of the connecting devices are integrally connected with each other to form a conducting member 42.

Figure 22:
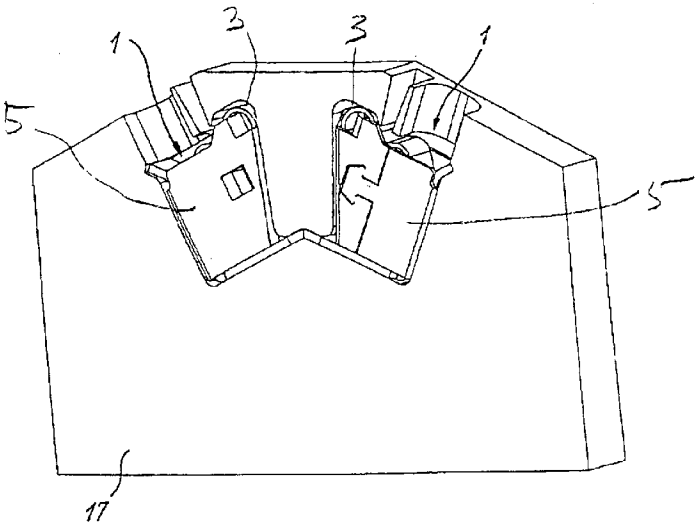
FIGS. 22 and 23 are perspective views illustrating a pair of the electrical connectors of the present invention mounted in a common housing.
Figure 23:
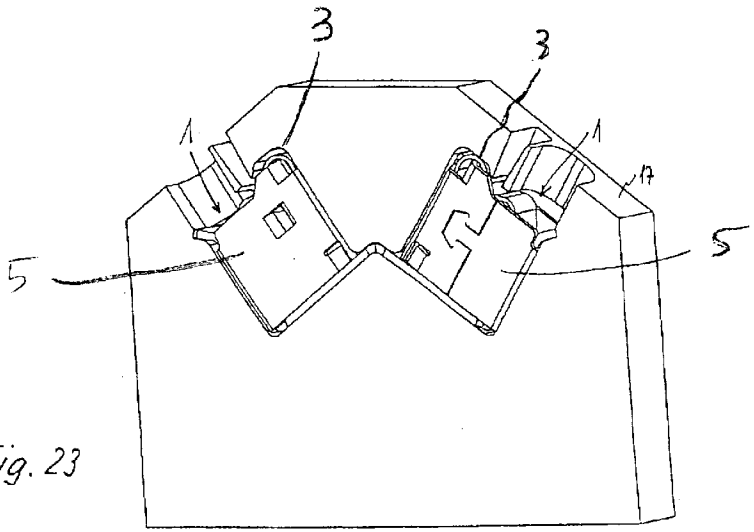

FIGS. 22 and 23 show a terminal block with two connecting devices 1, which are tapered downward. One can readily see that this terminal block compared to FIG. 3 has a narrower structure with nontapering connecting devices 1 in the manner of FIG. 1.

Figure 24:
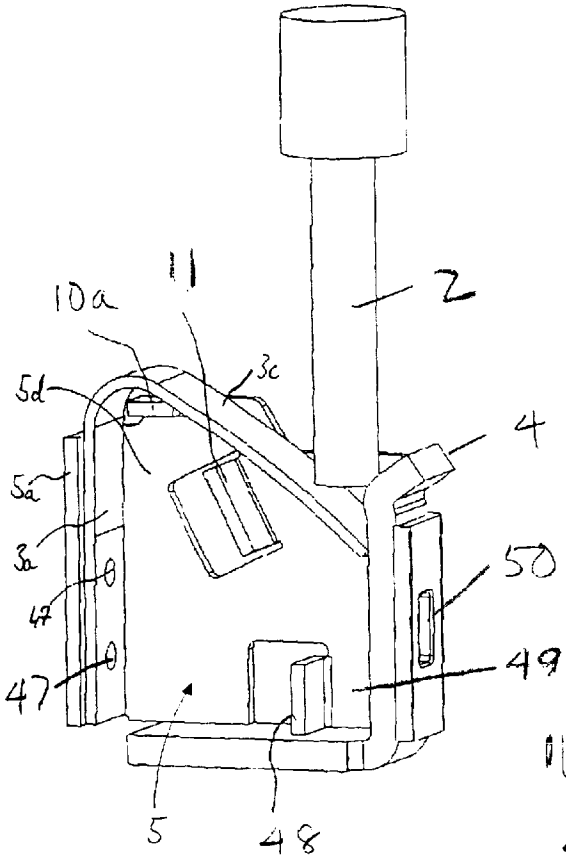

FIG. 24 shows another exemplary embodiment of the invention, where the resilient contact 3 is embossed upon the metal housing specifically by means of cheap and durable embossings 47 in the area of longitudinal leg 3*a* that rests on the first side wall 5*a*. Punchouts 36, 37 of FIGS. 1*a* and 1*b* in the side walls 5*b* and 5*d* in the corner areas toward the first side wall 5*a* are not required. An additional embossing 50 can be provided between bus bar 4 and metal housing 5.

Figure 25:
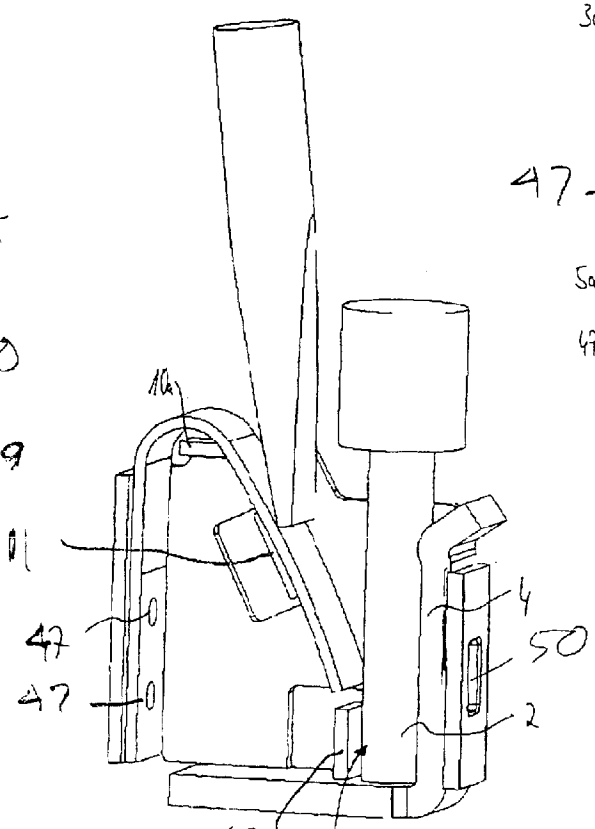

Additional punchouts 48, for example, in the side walls 5*b* and 5*d* in the corner areas toward bus bar 4, are so arranged and bent inward that between them and bus bar 4, there will be defined an insertion and receiving chamber 49 for the conductor which facilitates the insertion of conductor 2 and which improves the defined seat of conductor 2 in the connecting device (FIG. 25).

Figure 26:
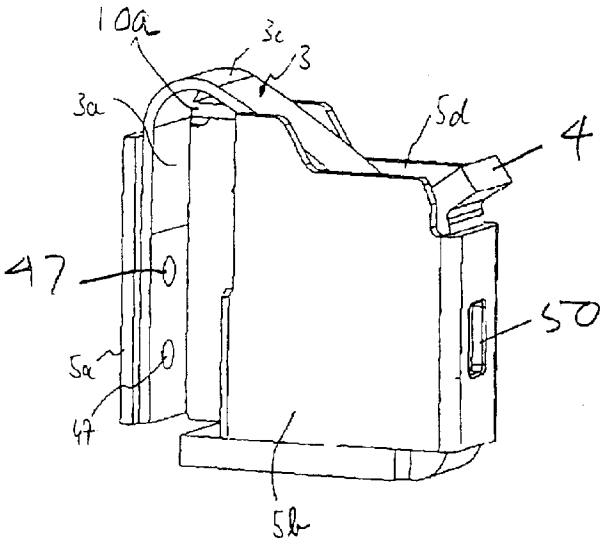
FIGS. 24–26 are perspective views of a further embodiment of the invention of FIG. 1*a;*

According to FIGS. 24 to 26, the interlocking connection can also be provided in the manner of FIG. 1*a*. As an alternative, the second wall 5*b* is bent at its free end itself as a replacement of bar 10*b* from FIG. 1 toward the interior of metal housing 5 in order thus to make a particularly secure support area for bending sector 3*c* of the friction spring 3 and at the same time to close and stabilize metal housing 5 (FIG. 26). Bridge 10*a* can be retained, for example; in this case, however, it is simply folded inward as a punchout from the upper edge of wall 5*d* (FIG. 25).

Figure 27C:
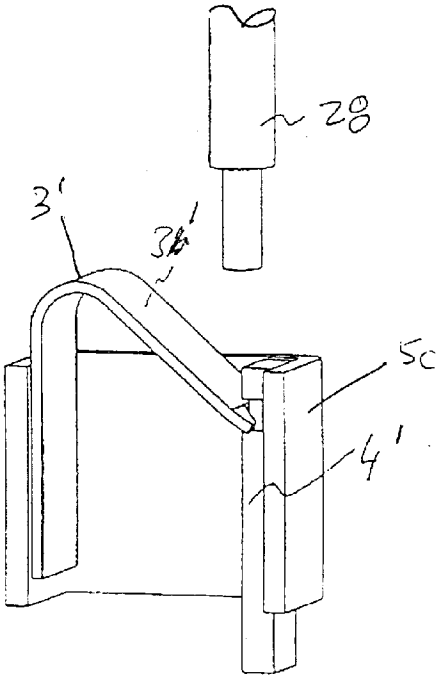
FIG. 27*c* illustrates the connector assembly of FIG. 27*a* in the fully disengaged condition.
Figure 27B:
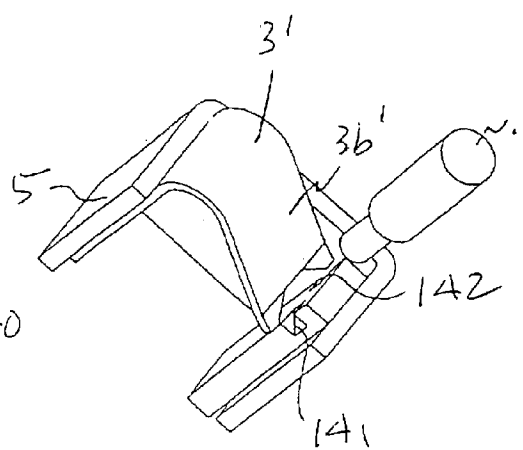
FIGS. 27*a* and 27*b* are perspective views of a connector assembly in which the clamping leg of the resilient contact is bifurcated.
Figure 27A:
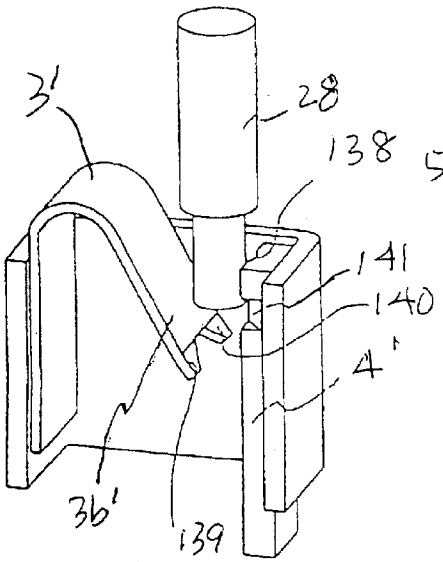

Referring now to the modification illustrated in FIGS. 27*a*–27*c*, in order to enhance the engagement between conductor 28 and the bus bar 4, the bus bar may be provided with a centering groove 138 that partially receives the bare portion of conductor 28, whereby the conductor is stabilized and centered relative to the bus bar 4'. Furthermore, the free end of the clamping leg 3*b'* of the resilient contact 3' may be bifurcated, thereby to define the sharp pointed extremity portions 139 and 140 that are adapted to cooperate with corresponding notches 141 and 142 provided in the edges of the bus bar 4' when the conductor 28 is removed from the connector, as shown in FIGS. 27*c* and 28*a*. For the sake of simplicity, the bridge support portion 10*a*, the limiting projection 11, and the leg locking projection of FIG. 1*b* have been omitted in FIGS. 27*a*–27*c*.

Figure 28B:
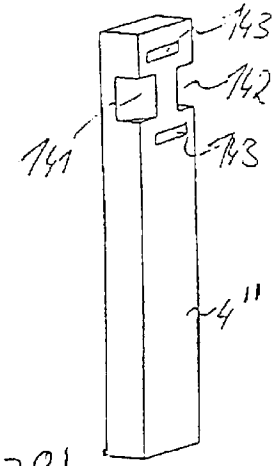
FIG. 28*b* is a perspective view of a modification of the bus bar of FIG. 28*a*.
Figure 28A:
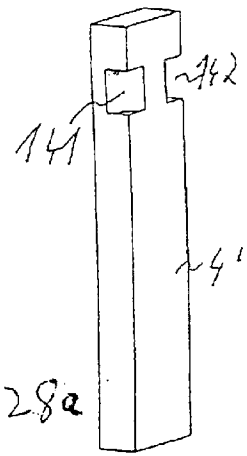
FIG. 28*a* is a perspective view of the bus bar of FIG. 27*a*.

As shown in FIG. 28*b*, the engagement between the conductor and the bus bar 4" might be further enhanced by the provision of grooves 143 above and below the notches 141 and 142.

Figure 29A:
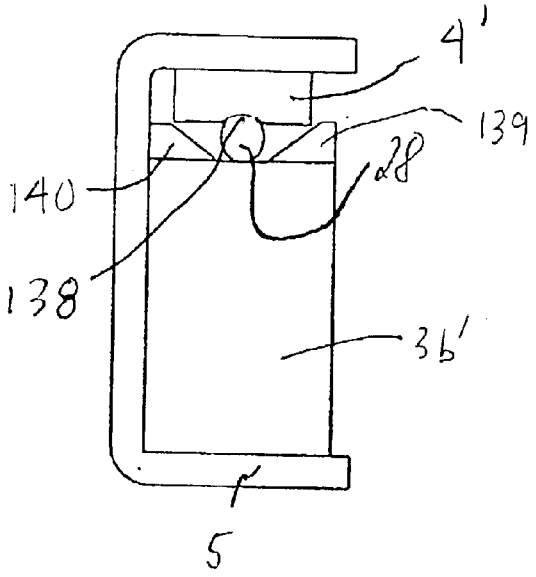
FIGS. 29*a*–29*d* are top plan illustrating the biasing of different sizes and numbers of conductors against a bus bar by means of the bifurcated contact leg of FIG. 27*a*.
Figure 29B:
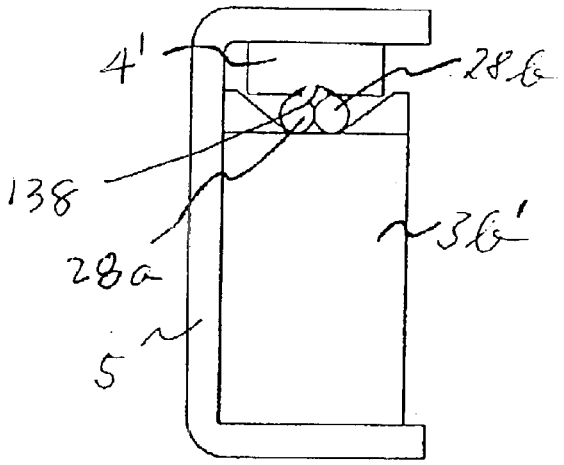
Figure 29C:
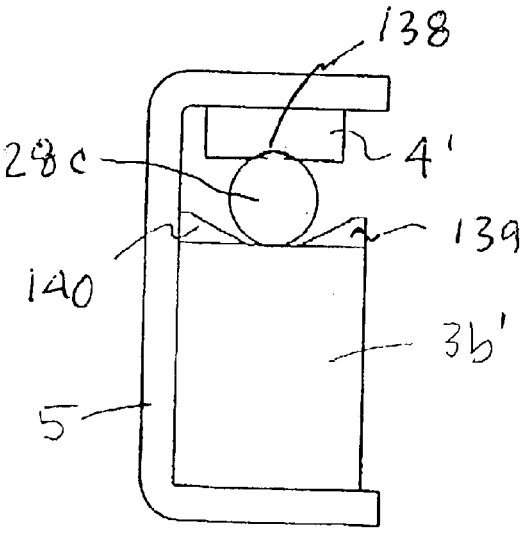
Figure 29D:
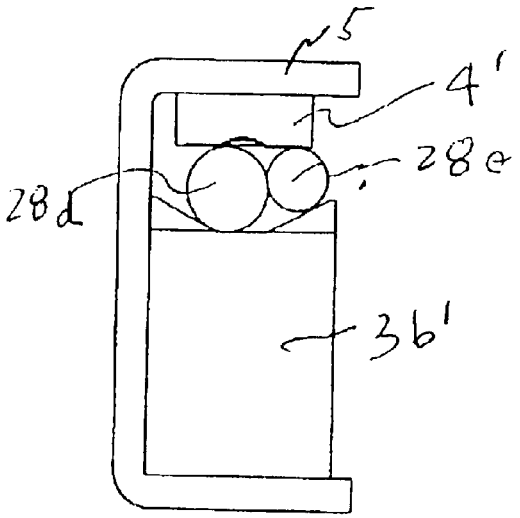

Referring now to FIG. 29*a*, it will be seen that the centering groove 138 serves to center the conductor 28 relative to the bus bar 4'. As shown in FIG. 29*b*, a pair of conductors 28*a* and 28*b* may be positioned relative to the bus bar by the pointed extremities 139 and 140 of the bus bar 4'. The diameters of the conductors may vary. As shown in FIG. 29*c*, a conductor 28*c* of larger diameter that is inserted between the pointed end portions 139 and 140 of the clamping leg 3*b'* and the bus bar 4' is centered by the centering groove 138, and a pair of larger diameter conductors 28*d* and 28*e* may be introduced between the clamping leg and bus bar 4' and will be biased into engagement with the bus bar by the pointed portions 139 and 140.

While in accordance with the provisions of the Patent Statutes the preferred forms and embodiments of the invention have been illustrated and described, it will be apparent to those skilled in the art that changes may be made in the disclosed apparatus without deviating from the inventive concepts set forth above.

What is claimed is:

1. An electrical connector for connecting a conductor (2) to a bus bar (4), comprising:

(a) a hollow metal housing (5) having a first end wall (5*a*), at least one vertical side wall (5*d*), and a second end wall (5*c*) cooperating with said first end wall and said side wall to form a open-topped chamber;

(b) means defining a bus bar (4) in said chamber adjacent said second end wall (5*c*);

(c) an inverted generally U-shaped resilient contact (3) having first and second leg portions (3*a*, 3*b*) extending downwardly in said chamber adjacent said housing end walls, respectively, and a bridging portion (3*c*) adjacent the open top of said chamber;

(d) connecting means (7,8; 47) connecting said first leg portion (3*a*) with said first housing end wall, said second leg portion (3*b*) being biased outwardly toward said second housing end wall, thereby to bias a conductor (2) introduced downwardly into said chamber between said bus bar means and said first housing end wall toward engagement with said bus bar means;

(e) a first support portion (10*b*) carried by said housing side wall for supporting said resilient contact bridging portion; and (f) stop means (11) carried by said housing side wall for limiting the extent of displacement of said second contact leg portion toward said first contact leg portion.

2. An electrical connector as defined in claim 1, wherein said connecting means comprises a integral locking tab portion (7) partially punched out from said first housing end wall and joined thereto at its upper end by a horizontal bend line (8), said tab portion having a lower stop edge (9) extending into a corresponding opening (6) contained in said first leg portion.

3. An electrical connector as defined in claim 1, wherein said bus bar means comprises an L-shaped bus bar (4) having a vertical upper portion (4*a*) that extends between said resilient contact second leg and said housing second end wall, and a horizontal lower portion (4*b*).

4. An electrical connector as defined in claim 3, wherein said bus bar horizontal lower portion (4*a*) extends beneath said housing and serves as a stop for limiting the extent of introduction of the conductor into said housing chamber.

5. An electrical connector as defined in claim 1, wherein said housing is formed of an electrically conductive metal from the group consisting of copper and aluminum.

6. An electrical connector as defined in claim 1, wherein said housing includes a second side wall (5*b*) having a second support portion (10*a*) for supporting said contact bridging portion.

7. An electrical connector as defined in claim 6, wherein said first and second support portions (10*a*, 10*b*) are bent inwardly form their associated side walls and each have a length that is about one-half the width of said resilient contact.

8. An electrical connector as defined in claim 1, wherein said second leg portion of said resilient contact is planar.

9. An electrical connector as defined in claim 1, wherein said second leg portion of said resilient contact has a serpentine configuration, thereby to enhance the engagement of said second leg portion by the tip of a screwdriver (16) during the disengagement of the resilient contact from the conductor.

10. An electrical connector as defined in claim 1, wherein said housing includes a sectional second side wall (5*b*) parallel with and spaced from said first side wall, said housing being formed by bending a metal sheet to define said side and end walls; and further including locking means (13) for locking together said side wall sections to define a rigid housing.

11. An electrical connector as defined in claim 1, wherein said housing includes a second side wall (5*b*) parallel and spaced from said first side wall, said side walls including partially punched out portions (36,37) that press said resilient contact first leg portion (3*c*) against said housing first end wall.

12. An electrical connector as defined in claim 1, wherein said resilient contact second leg portion (3*b*) engages said bus bar means when the conductor is removed from said housing chamber.

13. An electrical connector as defined in claim 12 and further including a terminal block body (17) formed of electrical insulating material and containing a cavity (18) receiving said metal housing, said terminal block body containing a first access opening (20) for introducing a conductor into said cavity and into said housing chamber, and at least one second access opening (19;19') above said resilient contact second leg portion for receiving disengaging means (16;21) to disengage said resilient contact from the conductor.

14. An electrical connector as defined in claim 13, wherein said disengaging means is the tip of a screwdriver (16).

15. An electrical connector as defined in claim 13, wherein said disengaging means includes a slidably mounted member (21) operable by the tip of a screwdriver to engage the resilient contact from the conductor.

16. An electrical connector as defined in claim 15, wherein said resilient contact second leg has a serpentine configuration for engagement by said slidably mounted member.

17. An electrical connector as defined in claim 15, wherein said slidably mounted member (21) includes an enlarged marking area (38) that extends within a corresponding enlarged recess (39) contained in said terminal block body.

18. An electrical connector as defined in claim 1, wherein said housing first wall (5*a*) is inwardly tapered downwardly in the direction of insertion of said resilient contact first leg portion.

19. An electrical connector as defined in claim 1, wherein said resilient contact first leg portion contains a convex strengthening bulge (15) that extends outwardly from said housing first wall (5*a*).

20. An electrical connector as defined in claim 1, wherein said resilient connector bridging portion (3*c*') has a thickness that is greater than the thickness of said first and second leg portions (3*a*, 3*b*).

21. An electrical connector as defined in claim 1, and further including test probe means (24) for engaging said housing first wall to determine the condition of said resilient connector relative to said bus bar.

22. An electrical connector as defined in claim 3, wherein said bus bar horizontal portion (4*a*) extends inwardly wider said resilient contact second leg portion and terminates in a downwardly extending extension portion (4*c*); wherein said resilient contact first leg portion terminates at its lower end in and inwardly bent portion (3*d*) that cooperates with said bus bar extension portion to define a female contact for receiving a male pin plug (25); and further wherein said housing first wall (5*a*) terminates at its lower end in an inwardly bent stop extension (5*e*) arranged beneath said resilient contact extension portion to limit the extent of downward travel thereof.

23. An electrical connector as defined in claim 1, and further including tap plug means (27,28) adapted for insertion between said resilient contact first leg portion (3*a*) and said housing first end wall (5*a*).

24. An electrical connector as defined in claim 23, wherein the lower extremity of said resilient contact first leg portion terminates in a tab portion (26) bent outwardly from said housing first wall, thereby to define an opening for receiving said tap plug.

25. An electrical connector as defined in claim 1, wherein said metal housing includes downwardly extending soldering lugs (29) adapted for connection with a printed circuit board (23).

26. An electrical connector as defined in claim 1, and further including fastening devices (35) for fastening the lower edge portion of said metal housing to a printed circuit board.

27. An electrical connector as defined in claim 1, wherein a plurality of said electrical connectors are arranged in a row, said connectors having a common conductive plate (42) extending below the housings thereof.

28. An electrical connector as defined in claim 13, and further including retaining means for retaining said housing in said terminal block body cavity, comprising an outwardly extending locking projection (45) on said housing that extends within a corresponding locking recess contained in the wall of said terminal block body cavity.

29. An electrical connector as defined in claim 1, wherein said connecting means includes embossing means (47) connected between said resilient contact first leg portion and said housing first end wall.

30. An electrical connector as defined in claim 1, wherein said side wall includes a partially punched out portion (48) that extends adjacent and in parallel spaced relation relative to said housing second end wall, thereby to define a retaining slot (49) for receiving a conductor introduced between said resilient contact second leg portion and said housing second end wall.

31. An electrical connector as defined in claim 3, and further including embossing means (50) for connecting said bus bar vertical portion **(4*a*) with said housing second end wall (5*c*)**.

32. An electrical connector as defined in claim 1, wherein the free end of said resilient contact second leg portion **(3*b*') is bifurcated to define a pair of pointed centering portions (139, 140)**.

33. An electrical connector as defined in claim 32, wherein said bus bar contains a centering groove (138) for centering a conductor relative to said second contact leg pointed centering portions (139, 140).

34. An electrical connector as defined in claim 33, wherein said second contact leg portion engages said bus bar means when the conductor is removed from the connector.

35. An electrical connector as defined in claim 34, wherein said bus bar contains notches (141, 142) for receiving said centering projections, respectively, when the conductor is removed from said connector.

36. An electrical connector as defined in claim 35, wherein said bus bar further contain at least one groove (143) adjacent said notches.

37. An electrical connector for connecting a conductor to a bus bar, comprising:

(a) a metal housing formed of a conductive metal and having a vertical side wall, and parallel spaced first **(5*a*) and second (5*b*)** vertical end walls arranged orthogonally relative to said side wall and cooperating therewith to define an open-topped chamber, said second end wall defining a bus bar;

(b) an inverted generally U-shaped resilient contact (3) having a pair of leg portions **(3*a*, 3*b*) extending downwardly in said chamber adjacent said housing endwalls, respectively, and a bridging portion (3*c*) adjacent the open top of said chamber, (c) connecting means (7) connecting said first leg portion (3*a*) with said first housing end wall, second leg portion (3*b*) being biased outwardly toward said second housing end wall, thereby to bias a conductor (2)** introduced downwardly into said chamber between said bus bar means and said first housing end wall toward engagement with said second end wall;

(d) first support means **(10*a*) carried by said housing side wall for supporting said resilient contact bridging portion; and (e) stop means (11)** carried by said housing side wall for limiting the extend of displacement of said second contact leg portion toward said first contact portion.

* * * * *